US005807076A

United States Patent [19]

Kawaguchi et al.

[11] Patent Number: 5,807,076

[45] Date of Patent: Sep. 15, 1998

[54] LUBRICATION METHOD AND LUBRICATION CONTROLLING APPARATUS FOR CLUTCHLESS COMPRESSOR

[75] Inventors: Masahiro Kawaguchi; Masanori Sonobe; Ken Suitou, all of Kariya; Takashi Michiyuki, Anjo; Masahiko Okada; Tomohiko Yokono, both of Kariya, all of Japan

[73] Assignee: Kabushiki Kaisha Toyoda Jidoshokki Seisakusho, Kariya, Japan

[21] Appl. No.: 702,606

[22] PCT Filed: Nov. 17, 1995

[86] PCT No.: PCT/JP95/02354

§ 371 Date: Aug. 28, 1996

§ 102(e) Date: Aug. 28, 1996

[87] PCT Pub. No.: WO96/31699

PCT Pub. Date: Oct. 10, 1996

[30] Foreign Application Priority Data

Apr. 7, 1995 [JP] Japan ..... 7-082741

[51] Int. Cl.[6] ..... F04B 39/04

[52] U.S. Cl. ..... 417/228; 417/53; 417/222.2; 184/6.3; 184/6.17; 92/154

[58] Field of Search ..... 417/53, 222.7, 417/228, 270; 418/1, 84, 100; 184/6.3, 6.17; 92/154

[56] References Cited

U.S. PATENT DOCUMENTS 3,844,684 10/1974 Kawamura .
4,862,700 9/1989 Suzuki ..... 417/53
5,173,032 12/1992 Taguchi et al. .
5,586,870 12/1996 Kawaguchi et al. ..... 417/222.2
5,603,610 2/1997 Kawaguchi et al. ..... 417/222.2

FOREIGN PATENT DOCUMENTS 0628722 12/1994 European Pat. Off. .
62-119483 7/1987 Japan .
62-191673 8/1987 Japan .
64-66477 3/1989 Japan .
3-37378 2/1991 Japan .

*Primary Examiner*—Charles G. Freay
*Attorney, Agent, or Firm*—Brooks Haidt Haffner & Delahunty

[57] ABSTRACT

An electromagnetic valve (32) opens and closes a pressurizing passage (31). When the pressurizing passage (31) is opened, a swash plate (15) mounted on a rotary shaft (9) inclines toward the minimum inclination. As the swash plate (15) inclines toward the minimum inclination, the swash plate (15) counteracts the spring force of a suction passage opening spring (24) and pushes a transmitting cylinder (28) and a shutter (21). The shutter (21) abuts against a positioning surface (27) when the swash plate inclination corresponds to a minimum inclination and disconnects a suction passage (26) from a suction chamber (3*a*). The disconnection impedes refrigerant circulation in the external refrigerant circuit (35). A refrigerant circulation controlling circuit (42) energizes the electromagnetic valve (32) and opens the pressurizing passage (31) for a certain time period starting from when a drive electric source (14) is activated.

22 Claims, 26 Drawing Sheets

LUBRICATION METHOD AND LUBRICATION CONTROLLING APPARATUS FOR CLUTCHLESS COMPRESSOR

TECHNICAL FIELD

The present invention relates to a lubrication method and a lubrication controlling apparatus for a clutchless compressor, which impedes the circulation of a refrigerant in an external refrigerant circuit in response to signals sent from a controller.

BACKGROUND ART

A variable displacement swash plate type compressor described in Japanese Unexamined Patent Publication 3-37378 does not employ an electromagnetic clutch that connects and disconnects an external drive source with a rotary shaft of the compressor for transmission of power. The omission of the electromagnetic clutch eliminates the discomfort of the impact caused when energizing or de-energizing the clutch, particularly in a vehicle. It also allows a reduction in the weight of the overall compressor and a decrease in costs.

In such clutchless compressors, there are problems concerning the amount of displacement when cooling is not required and frost forms in an evaporator provided in an external refrigerant circuit. The circulation of refrigerant should be impeded when cooling becomes unnecessary or when there is a possiblity of the formation of frost. The clutchless compressor described in Japanese Unexamined Patent Publication 3-37378 impedes the circulation of the refrigerant in the external refrigerant circuit by stopping the refrigerant gas in the external refrigerant circuit from flowing into a suction chamber. The flow of the refrigerant gas from the external refrigerant circuit to the suction chamber is controlled by energizing or de-energizing an electromagnetic valve which serves as a refrigerant circulation impeding means.

Stopping the refrigerant gas in the external refrigerant circuit from flowing into the suction chamber of the compressor causes a decrease of the pressure in the suction chamber and completely opens a displacement control valve that reacts to the pressure in the suction chamber. The opened valve allows the discharged refrigerant gas in a discharge chamber to flow into a crank chamber and increases the pressure therein. Additionally, the pressure decrease in the suction chamber also decreases the suction pressure in cylinder bores. As a result, the difference between the pressure in the crank chamber and the suction pressure in the cylinder bores becomes great. This causes a swash plate to incline to a minimum inclining angle and results in minimizing the displacement. The minimized displacement minimizes the torque of the compressor and prevents a power loss when cooling is not required.

However, the clutchless compressor is constantly connected to the engine of the vehicle that it is mounted on. Thus, the clutchless compressor rotates when the engine is running. Therefore, the necessity to distribute lubricating oil inside the compressor is higher for clutchless compressors in comparison with compressors provided with a clutch.

In the compressor described in Japanese Unexamined Patent Publication 3-37378, the refrigerant gas in the compressor circulates through a path defined by the cylinder chambers (cylinder bores), discharge chamber, crank chamber, and suction chamber. The lubricating oil contained in the circulating refrigerant gas lubricates the inside of the compressor. To ensure lubrication, the cross-sectional transit area of a passage, provided between the crank chamber and the suction chamber, is set within a certain range. However, there is no guarantee that a required amount of lubricating oil would be provided inside the compressor when lubricating oil is not flowing into the compressor from the external refrigerant circuit. Thus, there is no certainty that the required amount of lubricating oil would be provided inside the compressor.

SUMMARY OF THE INVENTION

An object of the invention is to insure adequate lubrication of the inside of a clutchless compressor. Accordingly, the invention is basically an apparatus for controlling lubrication of a clutchless compressor. The compressor is driven by a mechanical drive source to compress and recirculate refrigerant in a refrigerant circuit, and the refrigerant includes lubricant for the compressor. The apparatus includes a refrigerant circulation impeding means for impeding refrigerant from circulating in the refrigerant circuit. The impeding means is controllably adjusted between a circulation impeding position where refrigerant is impeded from circulation in the refrigerant circuit and a free-circulation position where refrigerant may freely circulate in the refrigerant circuit. A refrigerant circulation controller for controlling the impeding means is included such that the impeding means is set in its free-circulation position for a predetermined period of time starting from a time of activation of the drive source such that lubrication is positively supplied to the compressor by the refrigerant when the compressor is initially driven after a time of inactivity. The impeding means is set in its circulation impeding position when the predetermined period elapses. The invention also includes a method of controlling lubrication of the clutchless compressor.

BRIEF DESCRIPTION OF THE DRAWINGS

FIG. 23(*b*) is a circuit diagram.

DETAILED DESCRIPTION OF THE PREFERRED EMBODIMENTS

A first embodiment of the present invention will hereafter be described with reference to FIGS. 1 through 8.

Figure 1:
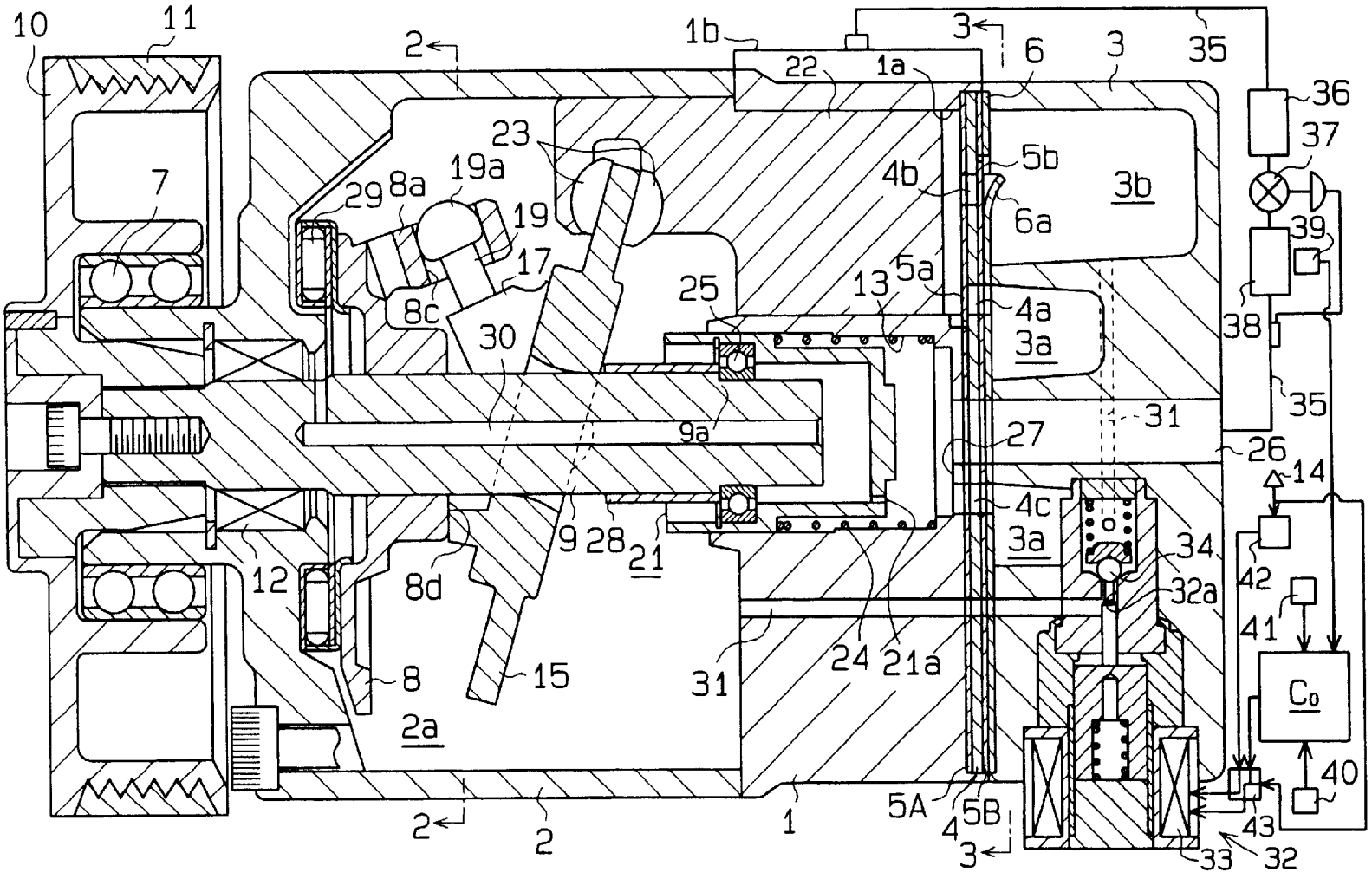
FIG. 1 is a cross-sectional side view showing an entire compressor according to a first embodiment of the present invention.

As shown in FIG. 1, a front housing 2 is secured to the front end of a cylinder block 1, which serves as part of a housing for the entire compressor. A rear housing 3 is secured to the rear end of the block 2 with a valve plate 4, valve forming plates 5A, 5B, and a retainer forming plate 6 provided in between. A rotary shaft 9 is rotatably supported to extend between the front housing 2, which serves as part of the housing and has a crank chamber 2*a* defined therein, and the cylinder block 1. The front end of the rotary shaft 9 protrudes outward from the crank chamber 2*a*. A driven pulley 10 is fixed to the protrusion. The driven pulley 10 is operably connected with a vehicle engine by way of a belt 11. The driven pulley 10 is supported by an angular contact bearing 7 on the front housing 2.

A lip seal 12 is provided between the front end of the rotary shaft 9 and the front housing 2. The lip seal 12 prevents pressure from escaping the crank chamber 2*a*.

Figure 2:
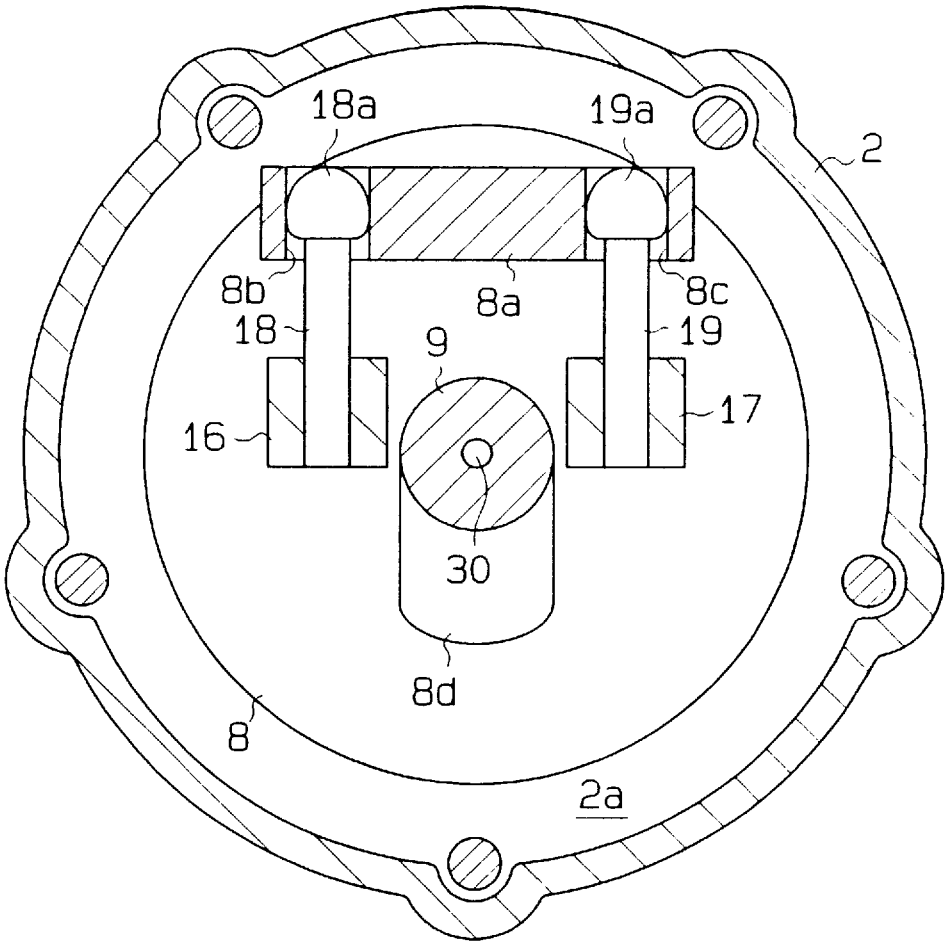
FIG. 2 is a cross-sectional view taken along line 2—2 in FIG. 1.

A rotary support body 8 is fixed to the rotary shaft 9. A swash plate 15 is slidably and tiltably supported with respect to the axial direction of the rotary shaft 9. As shown in FIG. 2, connecting pieces 16, 17 are fixed to the swash plate 15. A pair of guide pins 18, 19 are each secured to the connecting pieces 16, 17, respectively. Guide spheres 18*a*, 19*a* are formed on the distal section of the guide pins 18, 19, respectively. A support arm 8*a* projects from the rotary support body 8. A pair of guide holes 8*b*, 8*c* are formed in the support arm 8*a*. The guide spheres 18*a*, 19*a* are slidably fitted into the guide holes 8*b*, 8*c*, respectively. The connection between the support arm 8*a* and the pair of guide pins 18, 19 allows the swash plate 15 to be tiltable with respect to the axial direction of the rotary shaft 9 and enables integral rotation of the swash plate 15 with the rotary shaft 9. The tilting of the swash plate 15 is guided by the slide-guide relationship between the support arm 8*a* and the guide pins 18, 19 and the slide supporting action of the rotary shaft 9.

Figure 4:
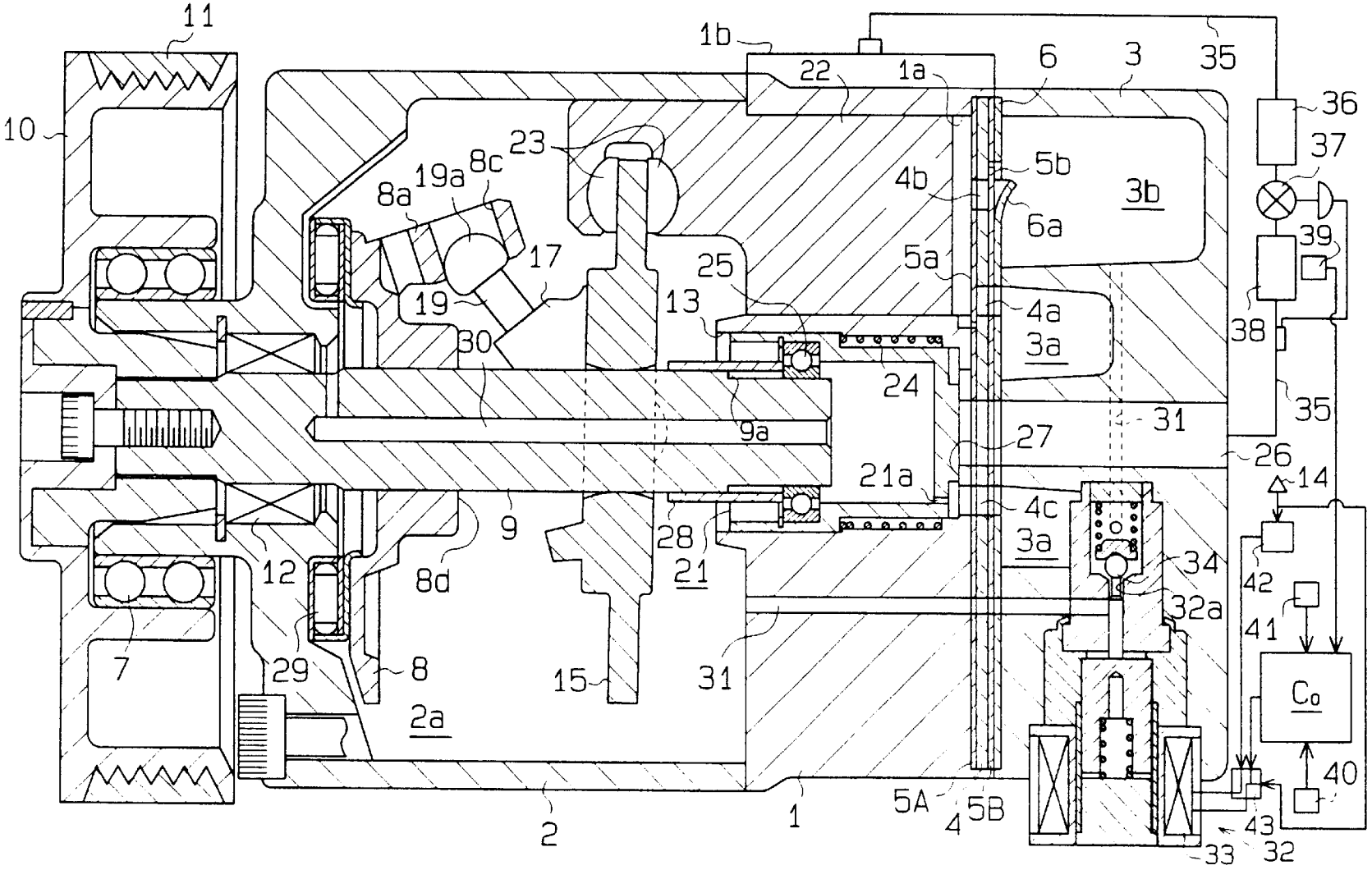
FIG. 4 is a cross-sectional side view showing the entire compressor with a swash plate at a minimum inclination.
Figure 5:
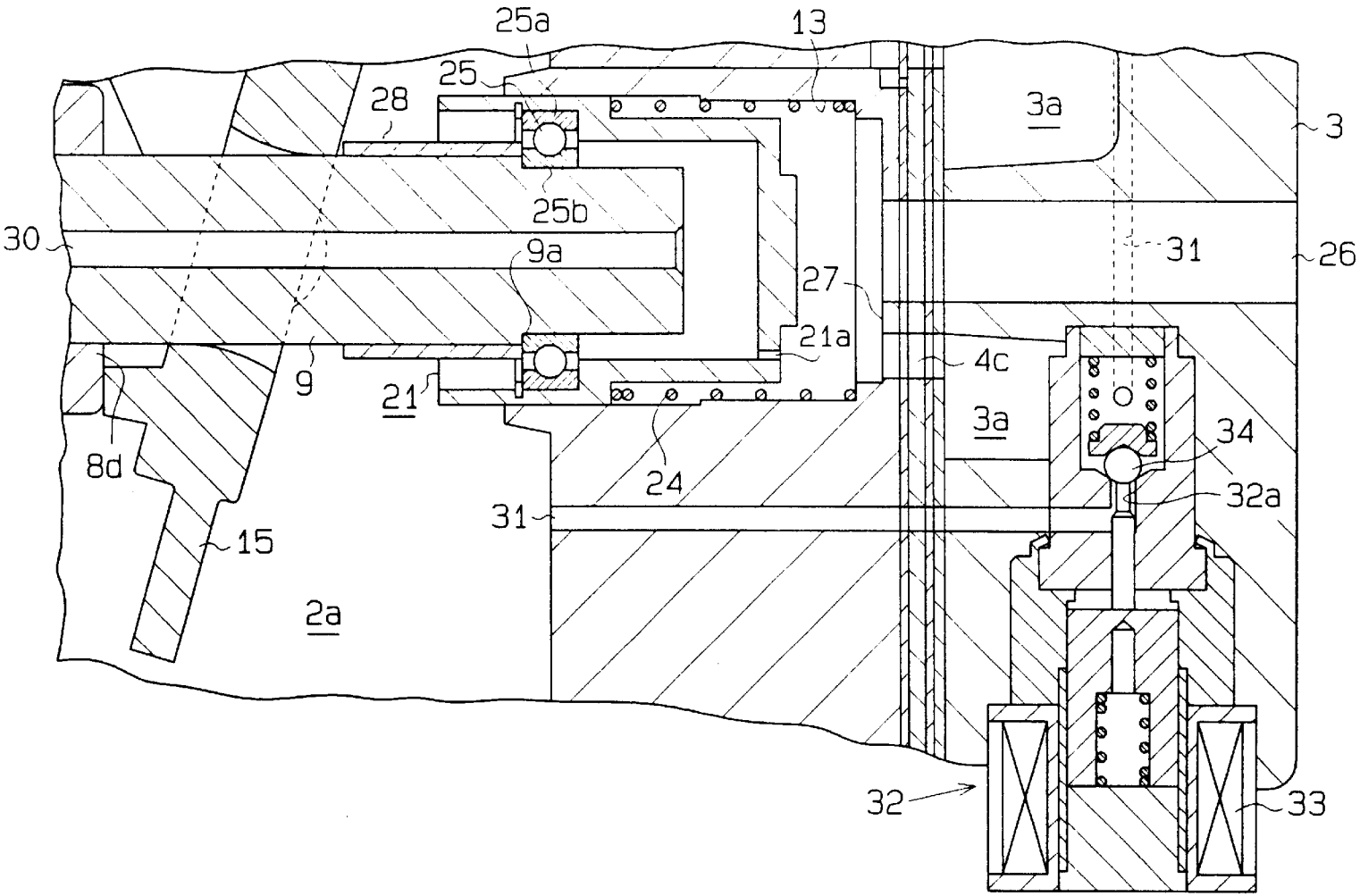
FIG. 5 is a partially enlarged cross-sectional view showing the swash plate at a maximum inclination.

As shown in FIGS. 1, 4, and 5, a retaining hole 13 is defined in the center of the cylinder block 1 along the axial direction of the rotary shaft 9. A tubular shutter 21 is slidably accommodated in the retaining hole 13. A suction passage opening spring 24 is arranged between the shutter 21 and the inner surface of the retaining hole 13. The opening spring 24 urges the shutter 21 toward the swash plate 21.

The rear end of the rotary shaft 9 is inserted into the shutter 21. A deep groove bearing 25 is arranged between the rear end of the rotary shaft 9 and the inner surface of the shutter 21. The rear end of the rotary shaft 9 is supported by the inner surface of the retaining hole 13 by way of the groove bearing 25 and the shutter 21. An outer race 25*a* of the groove bearing 25 is secured to the inner surface of the shutter 21. An inner race 25*b* of the groove bearing 25 is slidable on the peripheral surface of the rotary shaft 9. As shown in FIG. 5, a stepped portion 9*a* is defined on the peripheral surface at the rear end of the rotary shaft 9. The stepped portion 9*a* restricts the inner race 25*b* from moving toward the swash plate 15. That is, the stepped portion 9*a* restricts the groove bearing 25 from moving toward the swash plate 15. Accordingly, abutment of the groove bearing 25 against the stepped section 9*a* restricts the shutter 21 from moving toward the swash plate 15.

A suction passage 26 is defined in the center of the rear housing 3. The suction passage 26 is connected to the retaining hole 13. A positioning surface 27 is defined about the outlet of the suction passage 26 at the side of the retaining hole 13. The distal end of the shutter 21 is abuttable against the positioning surface 27. Abutment of the distal end of the shutter 21 against the positioning surface 27 restricts the shutter 21 from moving away from the swash plate 15 and disconnects the suction chamber 26 from the retaining hole 13.

A transmitting cylinder 28, which is slidable with respect to the rotary shaft 9, is arranged between the swash plate 15 and the groove bearing 25. One end of the transmitting cylinder 28 is abuttable against the swash plate 15 and the other end of the transmitting cylinder 28 is abuttable against the inner race 25*b* of the groove bearing 25 without abutting against the outer race 25*a*.

As the swash plate 15 moves toward the shutter 21, the swash plate 15 abuts against the transmitting cylinder 28 and presses the transmitting cylinder 28 against the inner race 25*b* of the groove bearing 25. The groove bearing 25 carries the load acting in both radial and thrust directions of the rotary shaft 9. The pressing action of the transmitting cylinder 28 urges the shutter 21 toward the positioning surface 27 against the spring force of the opening spring 24. This causes the distal end of the shutter 21 to abut against the positioning surface 27. Accordingly, minimum inclination of the swash plate 15 is restricted by the abutment between the distal end of the shutter 21 and the positioning surface 27. In other words, a minimum inclination restricting means is constituted by the shutter 21, the groove bearing 25, the positioning surface 27, and the transmitting cylinder 28.

The minimum inclination of the swash plate 15 is slightly greater than zero degrees. The minimum inclination is obtained when the shutter 21 is arranged at a closing position where it disconnects the suction passage 26 from the retaining hole 13. The shutter 21 moves together with the swash plate 15 between the closing position and an opening position located away from the closing position.

The maximum inclination of the swash plate 15 is restricted when an inclination restricting projection 8*d* of the rotary support body 8 abuts against the swash plate 15.

A single-headed piston 22 is retained in each of the cylinder bores 1*a*, which are formed in the cylinder block 1. connected to the crank chamber 2*a*. A pair of shoes 23 are fit into the neck of each piston 22. The rotational movement of the swash plate 15 is converted to the linear reciprocal movement of the piston 22 by way of the shoes 23. This reciprocally moves the piston 22 in its associated cylinder bore 1*a*.

Figure 3:
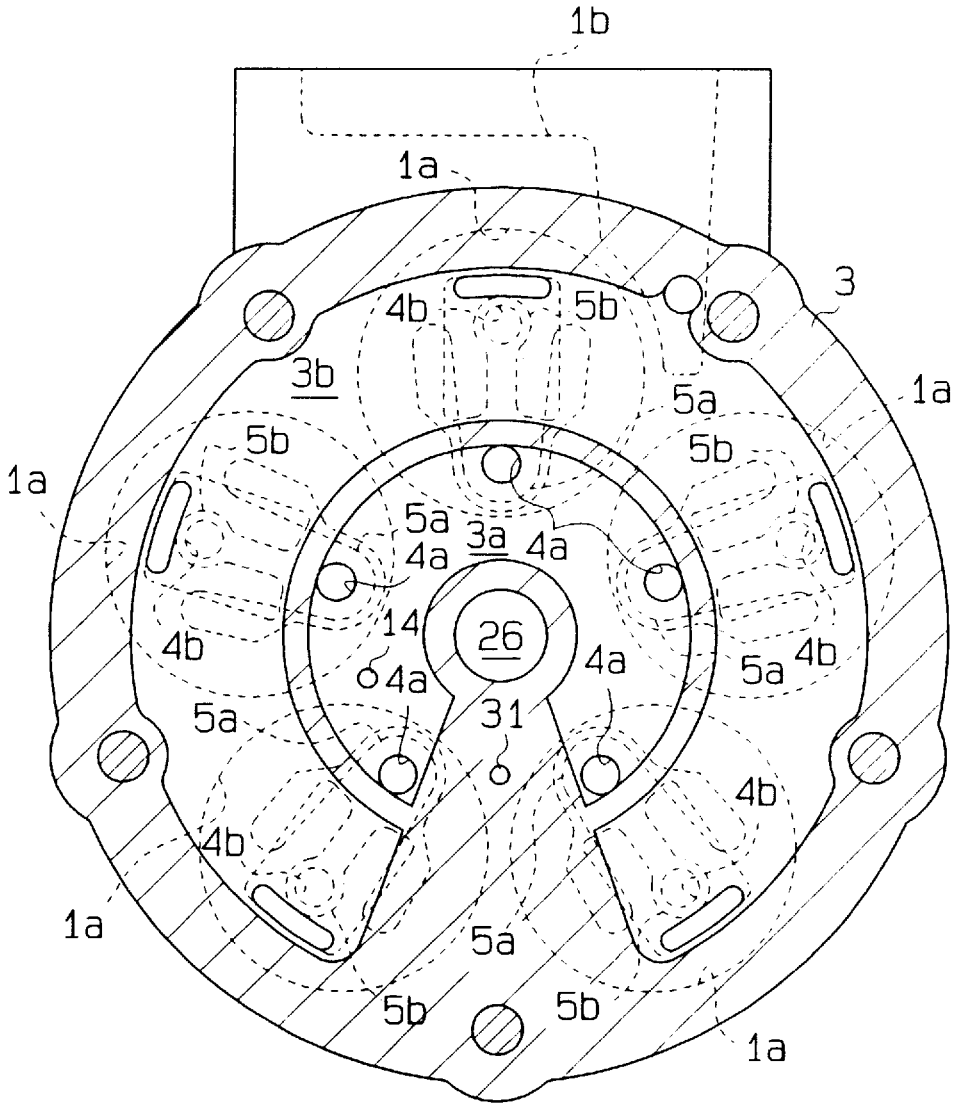
FIG. 3 is a cross-sectional view taken along line 3—3 in FIG. 1.

As shown in FIGS. 1 and 3, a suction chamber 3*a* and a discharge chamber 3*b* are defined in the rear housing 3. Suction ports 4*a* and discharge ports 4*b* are formed in the valve plate 4. Suction valves 5*a* are formed in the valve forming plate 5A. Discharge valves 5*b* are formed in the valve forming plate 5B. The reciprocation of each piston 22 causes the refrigerant gas in the suction chamber 3*a* to open the suction valve 5*a* and flow through the suction port 4*a* into the associated cylinder bore 1*a*. The reciprocation of each piston 22 then causes the refrigerant gas drawn into the associated cylinder bore 1*a* to open the discharge valve 5*b* and be discharged through the discharge port 4*b* into the discharge chamber 3*b*. Each discharge valve 5*b* abuts against a retainer 6*a* formed in the retainer forming plate 6.

A thrust bearing 29 is arranged between the rotary support body 8 and the front housing 2. The thrust bearing 29 carries the compression reaction acting on the rotary support body 8 by way of the cylinder bores la, the pistons 22, the shoes 23, the swash plate 15, the connecting pieces 16, 17, and the guide pins 18, 19.

The suction chamber 3*a* is connected to the retaining hole 13 through an aperture 4*c*. When the shutter 21 is located at the closing position, the aperture 4*c* is disconnected from the suction passage 26. The suction passage 26 serves as an entrance through which refrigerant gas flowing into the compressor is drawn. The position where the shutter 21 disconnects the suction passage 26 from the suction chamber 3*a* is located at the downstream side of the suction passage 26.

A conduit 30 is defined in the rotary shaft 9. The conduit 30 connects the crank chamber 2*a* with the inside of the shutter 21. As shown in FIGS. 1, 4, and 5, a pressure releasing hole 21*a* extends through the distal end of the shutter 21. The pressure releasing hole 21*a* connects the retaining hole 13 with the inside of the shutter 21.

As shown in FIGS. 1 and 4, the discharge chamber 3*b* and the crank chamber 2*a* are connected to each other through a pressurizing passage 31. An electromagnetic valve 32 is provided in the pressurizing passage 31. By energizing a solenoid 33 of the electromagnetic valve 32, a valve body 34 closes a valve hole 32*a*. By de-energizing the solenoid 33 of 30 the electromagnetic valve 32, the valve body 34 opens the valve hole 32*a*. In other words, the electromagnetic valve 32 opens and closes the pressurizing passage 31 which connects the discharge chamber 3*b* with the crank chamber 2*a*.

The suction passage 26, which the refrigerant gas from the suction chamber 3*a* is drawn through, is connected to an outlet 1*b*, which the refrigerant gas in the discharge chamber 3*b* is discharged through, by an external refrigerant circuit 35. A condenser 36, an expansion valve 37, and an evaporator 38 are provided in the external refrigerant circuit 35. The expansion valve 37 controls the flow rate of the refrigerant in accordance with the fluctuation of the gas pressure at the outlet side of the evaporator 38. A temperature sensor 39 is provided in the vicinity of the evaporator 38. The temperature sensor 39 detects the temperature of the evaporator 38. Data of the detected temperature is sent to a control computer $C_0$.

The control computer $C_0$ controls the energizing and de-energizing of the solenoid 33 of the electromagnetic valve 32 through an amplifying circuit 43. The control computer $C_0$ controls the energizing and de-energizing of the solenoid 33 through the amplifying circuit 43 in accordance with the data of the detected temperature sent from the temperature sensor 39. When an air-conditioning apparatus operating switch 40 is turned on, the control computer $C_0$ commands the de-energizing of the solenoid 33 if the detected temperature becomes equal to or lower than a predetermined temperature. A temperature value lower than the predetermined temperature reflects the condition at which frost may form in the evaporator 38.

The control computer $C_0$ is connected to the operating switch 40 and a revolution speed detector 41, which detects the engine speed. When the operating switch 40 is turned on, the control computer $C_0$ de-energizes the solenoid 33 based on certain data of the detected speed fluctuation sent from the speed detector 41. The control computer $C_0$ also de-energizes the solenoid 33 when the operation switch 40 is turned off.

Figure 7:
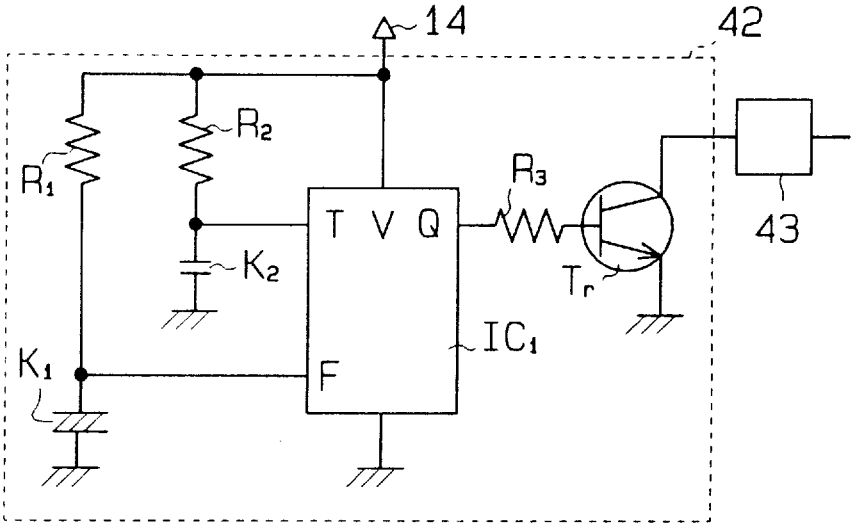
FIG. 7 is a circuit diagram of a refrigerant circulation controlling circuit.
Figure 8:
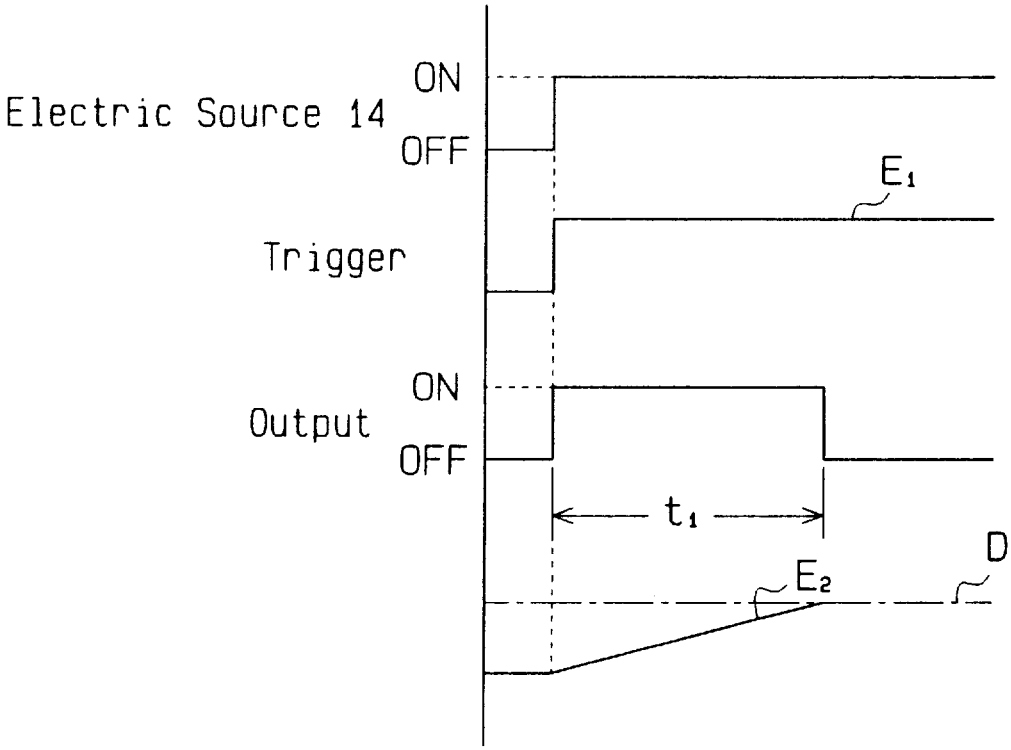
FIG. 8 is a graph illustrating the refrigerant circulation control.

A refrigerant circulation controlling circuit 42 is connected to an electric source 14 of the engine. The electric source provides electric power when the engine is started. The engine serves as a mechanical drive source that drives the compressor. The controlling circuit 42 is connected to the amplifying circuit 43. FIG. 7 illustrates an example of the circuit constitution of the controlling circuit 42. $R_1$, $R_2$, $R_3$ represent resistors, $K_1$, $K_2$ represent capacitors, Tr represents a switching transistor, $IC_1$, represents an integrated circuit, F represents a threshold terminal, T represents a trigger terminal, V represents an electric source terminal, and Q represents an output terminal. When the electric source 14 is activated, a trigger signal illustrated by a curve $E_1$ in FIG. 8 is input into the trigger terminal T. The integrated circuit $IC_1$ then sends an ON signal to the transistor Tr from the output terminal Q. When the transistor Tr is actuated, the amplifying circuit 43 supplies electric power to the electromagnetic valve 32 and energizes the electromagnetic valve 32. A signal illustrated by curve $E_2$ in FIG. 8 is input into the threshold terminal F. When the signal $E_2$ reaches the limit value indicated by a line D in FIG. 8, the integrated circuit $IC_1$ stops sending signals and the transistor Tr is turned off. Time period $t_1$, which is the length of time required for the signal $E_2$ to reach the line D, is proportional to the multiplied value of the resistor $R_1$ and the capacitors $K_1$. When the transistor Tr is de-actuated, the supply of electricity from the amplifying circuit 43 to the electromagnetic valve 32 is stopped. This de-energizes the electromagnetic valve 32.

The electromagnetic valve 32 serves as a swash plate inclination reducing means and also constitutes a refrigerant circulation impeding means together with the shutter 21. The solenoid 33 of the electromagnetic valve 32 corresponds to the electric drive circuit of the refrigerant circulation impeding means. When the transistor Tr of the refrigerant circulation controlling circuit 42 is de-actuated, a refrigerant circulation impeding command signal is transmitted. When the transistor Tr of the refrigerant circulation controlling circuit 42 is actuated, the output of the refrigerant circulation impeding command signal is stopped.

FIGS. 1 and 5 show the solenoid 33 in an energized state. In this state, the pressurizing passage 31 is closed. Accordingly, high-pressure refrigerant gas is not supplied to the crank chamber 2*a* from the discharge chamber 3*b*. In this state, the refrigerant gas in the crank chamber 2*a* keeps flowing into the suction chamber 3*a* through the conduit 30. This causes the pressure in the crank chamber 2*a* to approach the low pressure, or the suction pressure, in the suction chamber 3*a*. As a result, the swash plate 15 is maintained at the maximum inclination and displacement is maximum.

When the cooling load is small, and the discharging action is performed with the swash plate 15 maintained at the maximum inclination, the temperature of the evaporator 38 approaches the temperature at which frost starts forming. The temperature sensor 39 sends the detected temperature data of the evaporator 38 to the control computer $C_0$. When the detected temperature becomes lower than a predetermined temperature, the control computer $C_0$ de-energizes the solenoid 33. De-energizing of the solenoid 33 opens the pressurizing passage 31 and connects the discharge chamber 3*b* with the crank chamber 2*a*. Accordingly, the high-pressure refrigerant gas in the discharge chamber 3*b* is supplied to the crank chamber 2*a* through the pressurizing passage 31 and increases the pressure in the crank chamber 2*a*. The pressure increase in the crank chamber 2*a* immediately inclines the swash plate 15 to the minimum inclination side.

As the swash plate 15 approaches the minimum inclination with the transmitting cylinder 28 pressed against the inner race 25*b* of the groove bearing 25, the distal end of the shutter 21 approaches the positioning surface 27. This gradually restricts the cross-sectional transit area of the refrigerant gas between the suction passage 26 and the suction chamber 3*a*. This restricting action also gradually decreases the flow rate of the refrigerant gas flowing from the suction passage 26 to the suction chamber 3*a*, and gradually reduces the displacement. As a result, the discharge pressure is gradually decreased and sudden fluctuation of the compressor torque does not occur.

Figure 6:
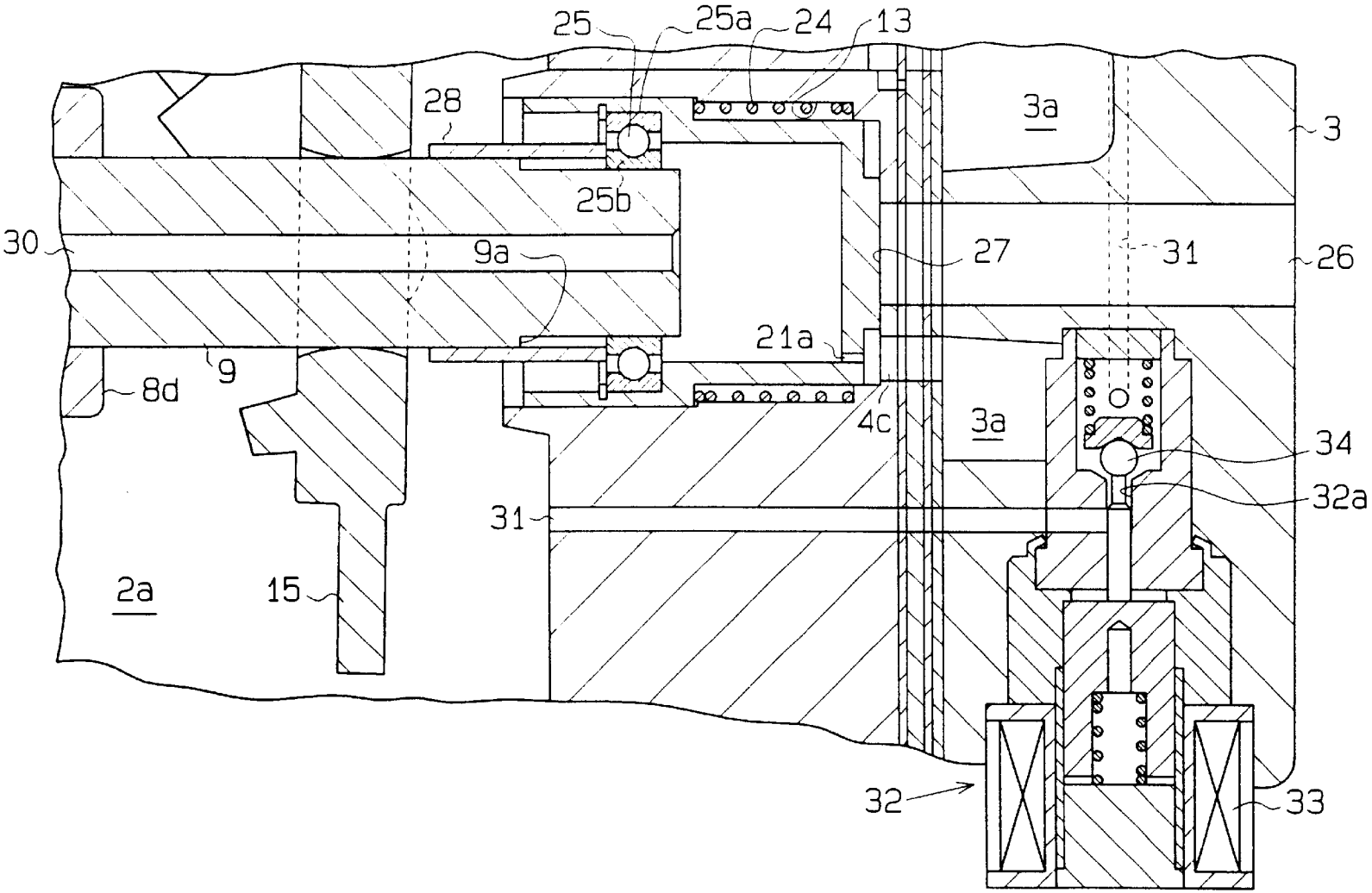
FIG. 6 is a partially enlarged cross-sectional view showing the swash plate at a minimum inclination.

As shown in FIGS. 4 and 6, abutment of the distal end of the shutter 21 against the positioning surface 27 causes the swash plate inclination to become minimum. Since the swash plate minimum inclination is not zero degrees, discharge from the cylinder bores 1*a* to the discharge chamber 3*b* is performer even when the swash plate inclination is minimum. Refrigerant gas discharged into the discharge chamber 3*b* from the cylinder bores 1*a* flows into the crank chamber 2*a* through the pressurizing passage 31. The refrigerant gas in the crank chamber 2*a* flows through the conduit 30 and a pressure releasing hole 21*a*, which serves as a pressure releasing passage. The refrigerant gas in the suction chamber 3*a* is drawn into the cylinder bores 1*a* and then discharged into the discharge chamber 3*b*. In other words, when the swash plate inclination is minimum, a circulation passage is defined in the compressor by the discharge chamber 3*b*, the pressurizing passage 31, the crank chamber 2*a*, the conduit 30, the pressure releasing hole 21*a*, the suction chamber 3*a*, and the cylinder bores 1*a*. The lubricating oil contained in the flowing refrigerant gas lubricates the inside of the compressor. In addition, there is a difference in the pressures of the discharge chamber 3*b*, the crank chamber 2*a*, and the suction chamber 3*a*.

When cooling load increases in the state shown in FIG. 6, the increase in the cooling load is reflected as a temperature increase in the evaporator 38 and the detected temperature of the evaporator 38 exceeds the predetermined temperature. The control computer $C_0$ energizes the solenoid 33 in accordance with the alteration in the detected temperature The energizing of the solenoid 33 closes the pressurizing passage 31 and releases the pressure in the crank chamber 2*a* through the conduit 30 and the pressure releasing hole 21*a* to decrease the pressure. This pressure decrease causes the swash plate 15 to incline from the minimum inclination to the maximum inclination.

The increase in the inclination of the swash plate 15 causes the shutter 21 to follow the inclination of the swash plate 15 due to the spring force of the opening spring 24. This separates the distal end of the shutter 21 from the positioning surface 27. This separation causes the cross-sectional transit area of the refrigerant gas passage between the suction passage 26 and the suction chamber 3*a* to gradually increase. The gradual increase in the cross-sectional transit area gradually increases the flow rate of the refrigerant gas flowing from the suction passage 26 to the suction chamber 3*a*, and gradually increases displacement. As a result, the discharge pressure is gradually increased and sudden fluctuation of the compressor torque does not occur.

By stopping the engine, the operation of the compressor is also stopped. This de-energizes the solenoid 33 and causes the swash plate inclination to become minimum. Accordingly, when the operation of the compressor is stopped, the swash plate inclination is kept minimum.

When the electric source 14 is activated to start the engine, the refrigerant circulation controlling circuit 42 stops sending refrigerant circulation impeding command signals starting a time period $t_1$, which is timed from when the engine is started. In other words, the electromagnetic valve 32 is energized during time period $t_1$, which is initiated from when the engine is started, and the pressurizing passage 31 is closed during time period $t_1$, initiated when the engine is started. This permits the refrigerant to freely circulate in the refrigerant circuit 35. Accordingly, the refrigerant gas in the discharge chamber 3*b* is not supplied to the crank chamber 2*a* through the pressurizing passage 31. This inclines the swash plate 15 from the minimum inclination to the maximum inclination. The increase in the inclination causes the refrigerant gas in the external refrigerant circuit 35 to flow into the compressor and lubricate the inside of the compressor with the lubricating oil contained in the refrigerant gas. Some of the lubricating oil introduced into the compressor is drawn into the cylinder bores 1*a* and enters the crank chamber 2*a* together with the blowby gas that leaks into the crank chamber 2*a* through the space between each cylinder bore 1*a* and the peripheral surface of the associated piston 22.

When the operation switch 40 is turned off, the control computer $C_0$ does not send commands to energize the electromagnetic valve 32. If the electromagnetic valve 32 remains de-energized after starting the engine, refrigerant circulation in the external refrigerant circuit 35 remains impeded. Thus, lubricating oil does not flow into the compressor and the lubricating oil in the compressor may not be sufficient when the engine is stopped. If the engine is started when the lubricating oil in the compressor is insufficient with the operating switch 40 turned off, the lubrication of the inside of the compressor becomes insufficient. Insufficient lubrication may cause seizure of the sliding portions inside the compressor.

In this embodiment, the refrigerant circulation controlling circuit 42 stops sending refrigerant circulation impeding command signals during time period $t_1$, which is initiated when the engine is started. This allows lubricating oil to be supplied into the compressor from the external refrigerant circuit 35. By supplying the lubricating oil in the external refrigerant circuit 35 into the compressor each time the engine is started, the problem of insufficient lubricating oil, during starting of the engine with the operation switch 40 turned off, is solved. In addition, the predetermined time period $t_1$ is determined by taking into consideration the prevention of frost formation in the evaporator 38.

A second embodiment of the present invention will hereafter be described with reference to FIGS. 9 through 11. Since the employed clutchless compressor is the same as the first embodiment, detailed description will not be given below.

Figure 9:
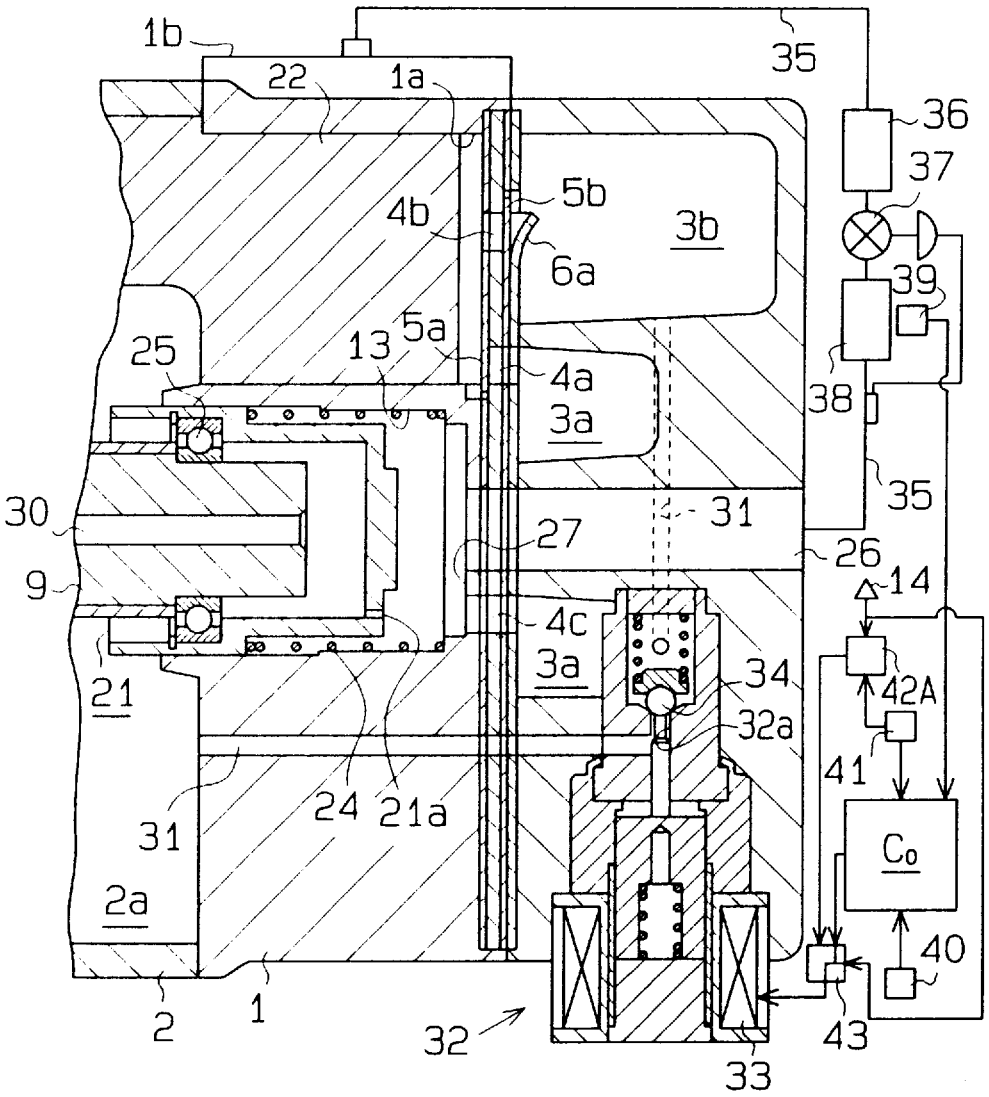
FIG. 9 is a partial cross-sectional view of a second embodiment.

As shown in FIG. 9, a refrigerant circulation controlling circuit 42A is connected to a speed detector 41. The refrigerant circulation controlling circuit 42A energizes and de-energizes the electromagnetic valve 32 in accordance with the data of the number of revolutions from the speed detector 41. The speed detector 41 detects the number of rotations of a rotating member driven by the drive source. That is, the refrigerant circulation controlling circuit 42A controls the impeding and allowing of the refrigerant circulation in the external refrigerant circuit 35.

Figure 10:
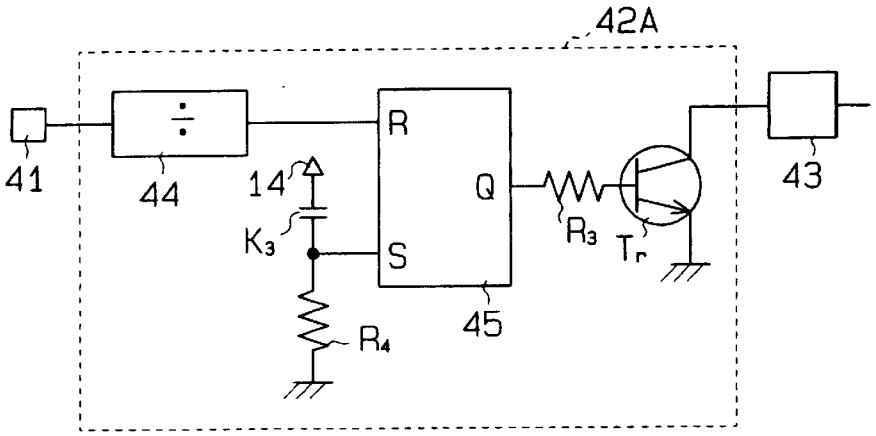
FIG. 10 is a circuit diagram of a refrigerant circulation controlling circuit.
Figure 11:
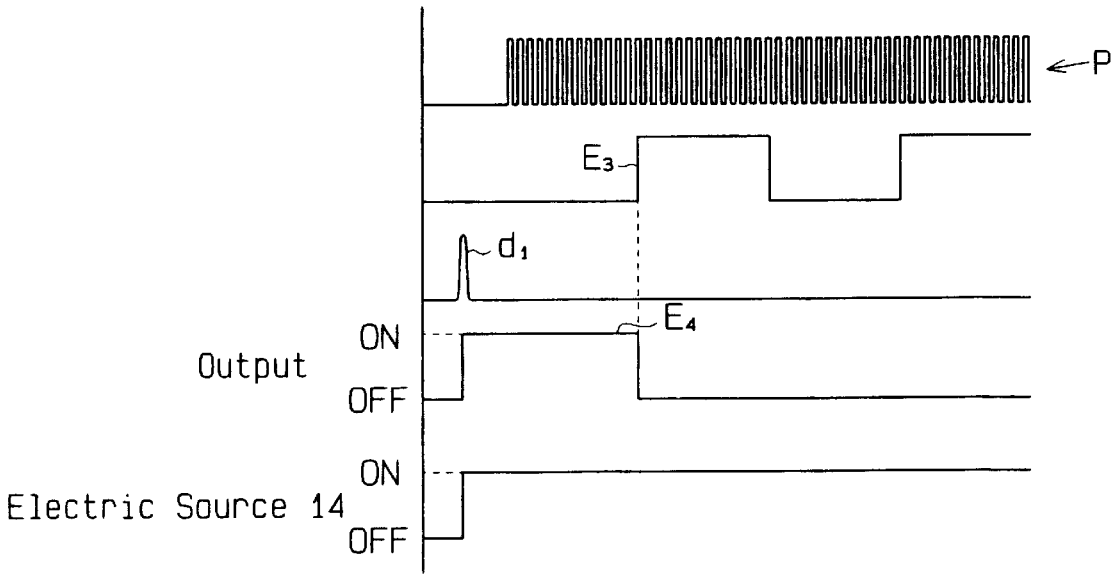
FIG. 11 is a graph illustrating the refrigerant circulation control.

FIG. 10 illustrates an example of a circuit constitution for a refrigerant circulation controlling circuit. 44 represents a dividing circuit, 45 represents a flip-flop circuit, $R_3$, $R_4$ represent resistors, and $K_3$ represents a capacitor. R represents a reset terminal and S represents a set terminal. The resistor $R_4$ and the capacitor $K_3$ constitute a differentiating circuit. The capacitor $K_3$ is connected to the electric source 14. The speed detector 41 sends a pulse signal P, shown in FIG. 11, to the dividing circuit 44. The dividing circuit 44 then outputs a square wave signal $E_3$, shown in FIG. 11, in accordance with the read pulse signal P. The differentiating circuit outputs a differentiating signal $d_1$ when the electric source 14 is turned on. In response to the read differentiating signal $d_1$, the flip-flop circuit 45 sends an ON signal $E_4$, which is indicative of curve $E_4$ and illustrated in FIG. 11, to the transistor Tr and actuates the transistor Tr. The differentiating signal is employed to avoid output instability of the ON signal $E_4$, which may be caused immediately after the electric source 14 is activated.

Electric power is supplied to the electromagnetic valve 32 by the amplifying circuit 43 when the transistor Tr is actuated. This causes refrigerant circulation in the external refrigerant circuit 35. The first onset of the square wave signal $E_3$ causes the flip-flop circuit 45 to stop transmitting the ON signal $E_4$ and de-actuates the transistor Tr. De-energizing of the transistor Tr causes the amplifying circuit 43 to stop supplying electric power to the electromagnetic valve 32. In other words, the de-actuated state of the transistor Tr in the refrigerant circulation controlling circuit 42A causes the refrigerant circulation impeding command signal to be output. The actuated state of the transistor Tr in the refrigerant circulation controlling circuit 42A stops the output of the refrigerant circulation impeding command signal.

In this embodiment, refrigerant circulation is performed until the number of revolutions reaches a predetermined value $N_1$ after the engine is started. This revolution value $N_1$ is determined by the dividing ratio of the dividing circuit 44. The output of the refrigerant circulation impeding command signal from the refrigerant circulation controlling circuit 42A is stopped until the predetermined revolution value $N_1$ is reached after starting the engine. Therefore, lubricating oil is also supplied into the compressor from the external refrigerant circuit 35 in this embodiment. Lubricating oil is supplied into the compressor from the external refrigerant circuit 35 each time the engine is started. This solves the problem of lubricating oil being insufficient when the engine is operated with the operation switch 40 turned off.

Figure 12:
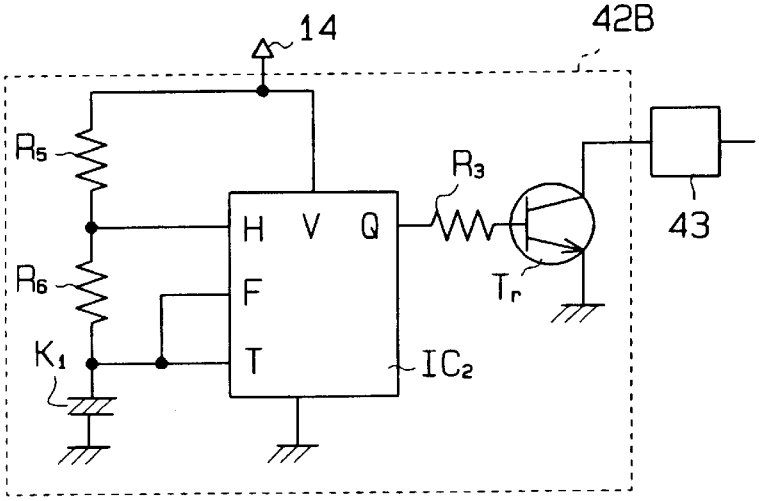
FIG. 12 is a circuit diagram of a refrigerant circulation controlling circuit according to a third embodiment.
Figure 13:
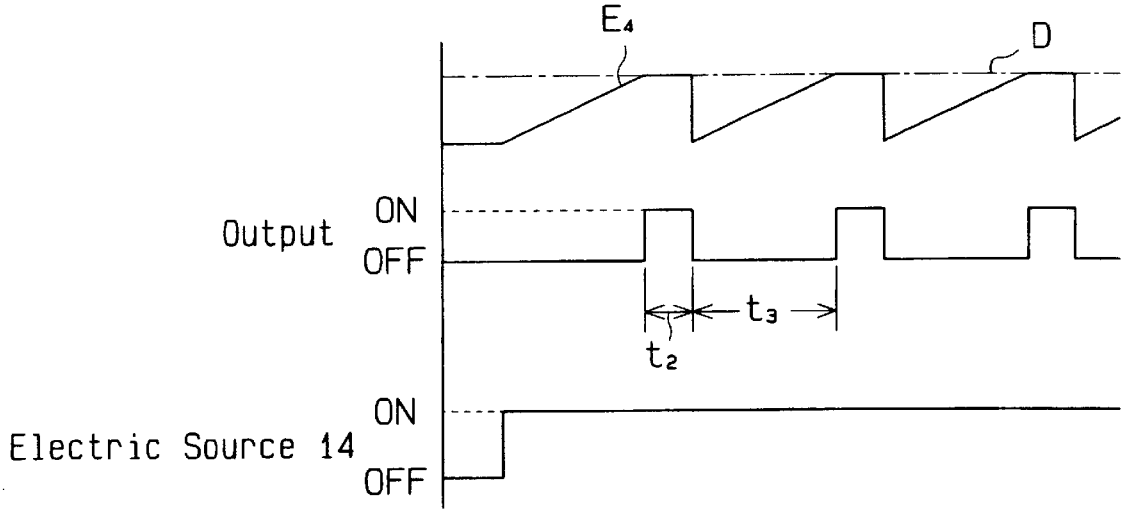
FIG. 13 is a graph illustrating the refrigerant circulation control.

A third embodiment will hereafter be described with reference to FIGS. 12 and 13. In this embodiment, a refrigerant circulation controlling circuit 42B, shown in FIG. 12, is employed instead of the refrigerant circulation controlling circuit 42 described in the first embodiment. The remaining constitution is the same as the first embodiment.

The refrigerant circulation controlling circuit 42B is an example of a circuit for controlling refrigerant circulation based on the predetermined time period. $R_5$, $R_6$ represent resistors, $IC_2$ represents an integrated circuit, and H represents a discharge terminal. When the electric source 14 is activated, a signal indicative of curve $E_4$ shown in FIG. 13 is input into the trigger terminal T and the threshold terminal F. When the signal $E_4$ reaches the limit value indicated by line D, the integrated circuit $IC_2$ sends an ON signal to the transistor Tr from the output terminal Q. When the transistor Tr is actuated, the amplifying circuit 43 supplies electric power to the electromagnetic valve 32 and energizes the electromagnetic valve 32. ON time period $t_2$ is proportional to the multiplied value of the resistor $R_6$ and the capacitor $K_1$. Afterwards, discharge is performed from the discharge terminal H, the integrated circuit $IC_2$ stops the output, and the transistor Tr is de-actuated. OFF time period $t_3$ is proportional to the multiplied value of the sum of the resistors $R_5$, $R_6$ and the capacitor $K_1$. When the transistor Tr is de-actuated, the supply of electric power from the amplifying circuit 43 to the electromagnetic valve 32 is stopped and the electromagnetic valve 32 is de-energized.

During the predetermined time period $t_3$, when the transistor Tr is de-actuated, the refrigerant circulation impeding command signal is transmitted. During the predetermined time period $t_2$, the period of which the transistor Tr is actuated, the output of the refrigerant circulation impeding command signal is stopped.

In this embodiment, when the engine is being operated, periodic intermittent controlling is performed by transmitting the refrigerant circulation impeding command signal from the refrigerant circulation controlling circuit 42B during the predetermined time period $t_2$ after the signal output is stopped during the predetermined time period $t_3$. In other words, lubricating oil is periodically supplied into the compressor from the external refrigerant circuit 35 when the engine is running. This solves the problem of insufficient lubricating oil when the engine is operated with the operation switch 40 turned off. In addition, the predetermined time periods $t_2$, $t_3$ are determined by taking into consideration the prevention of frost formation in the evaporator 38.

Figure 14:
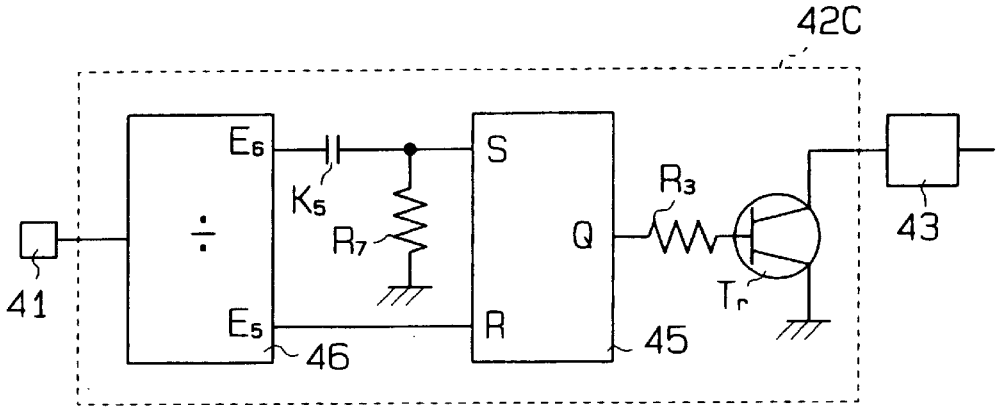
FIG. 14 is a circuit diagram of a refrigerant circulation controlling circuit according to a fourth embodiment.
Figure 15:
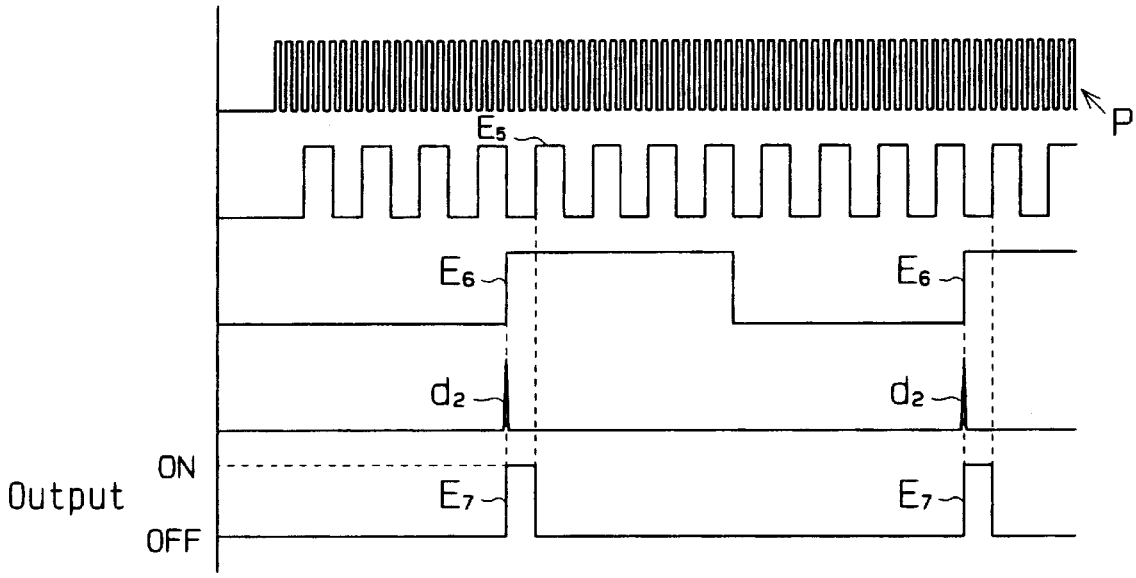
FIG. 15 is a graph illustrating the refrigerant circulation control.

A fourth embodiment of the present invention will hereafter be described with reference to FIGS. 14 and 15. In this embodiment, a refrigerant circulation controlling circuit 42C, shown in FIG. 14, is employed instead of the refrigerant circulation controlling circuit 42A described in the second embodiment. The remaining constitution is the same as the first embodiment.

FIG. 14 illustrates an example of a circuit constitution for controlling refrigerant circulation based on the revolution data. 45 represents the flip-flop circuit which is also employed in the second embodiment, 46 represents a dividing circuit, $R_7$ represents a resistor, and $K_5$ represents a capacitor. R represents a reset terminal and S represents a set terminal. The resistor $R_7$ and the condenser $K_5$ constitute a differentiating circuit. The speed detector 41 sends a pulse signal P, shown in FIG. 15, to the dividing circuit 46. The dividing circuit 46 then outputs a square wave signal $E_5$, $E_6$ shown in FIG. 15, in accordance with the read pulse signal P. The differentiating circuit sends a differentiating signal $d_2$ to the set terminal S for each onset of the square wave signal $E_6$. In response to the read differentiating signal $d_2$, the flip-flop circuit 45 sends an ON signal, which is indicative of curve $E_7$ and illustrated in FIG. 15, to the transistor Tr and actuates the transistor Tr. The actuation of the transistor Tr causes the amplifying circuit 43 to supply electric power to the electromagnetic valve 32 and circulate refrigerant in the external refrigerant circuit 35. The flip-flop circuit 45 stops transmitting the ON signal $E_7$ after the first onset of the square wave signal $E_5$ subsequent to the output of the differentiating signal $d_2$. This de-actuates the transistor Tr. De-actuating of the transistor Tr causes the amplifying circuit 43 to stop supplying electric power to the electromagnetic valve 32B. In other words, the transistor Tr is periodically actuated, in which state the output of the refrigerant circulation impeding signal is stopped.

Revolution value $N_3$ for determining the period which the ON signal $E_7$ is output and revolution period $N_2$ for determining the period which the ON signal $E_7$ is stopped from being output is determined by the two dividing ratios of the dividing circuit 46.

In this embodiment, when the engine is running, periodic intermittent controlling is performed by stopping the output of the refrigerant circulation impeding command signal from the refrigerant circulation controlling circuit 42C when the predetermined engine revolution value $N_3$ is reached after the revolution value $N_2$ is reached. In other words, lubricating oil is periodically supplied into the compressor from the external refrigerant circuit 35 when the engine is operated. This solves the problem of insufficient lubricating oil when the engine is operated with the operation switch 40 turned off. In addition, the predetermined revolution values $N_2$, $N_3$ are determined by taking into consideration the prevention of frost formation in the evaporator 38.

Figure 16:
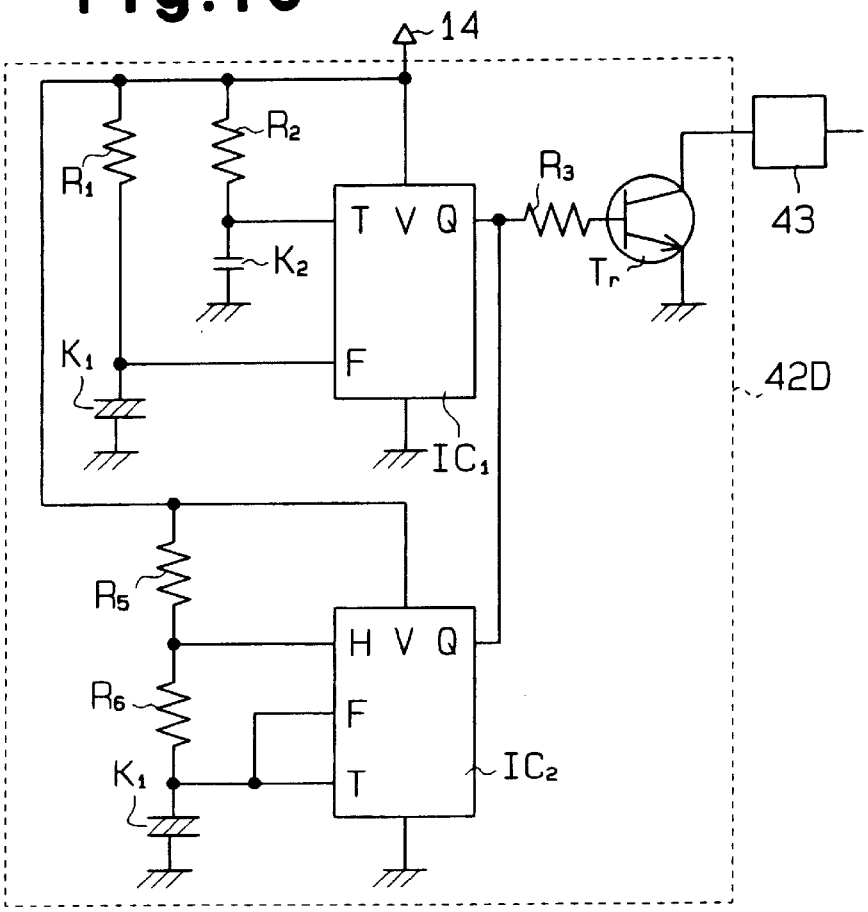
FIG. 16 is a circuit diagram of a refrigerant circulation controlling circuit according to a fifth embodiment.

A fifth embodiment will hereafter be described with reference to FIG. 16. In this embodiment, a refrigerant circulation controlling circuit 42D, which is a combination of the refrigerant circulation controlling circuit 42 described in the first embodiment and the refrigerant circulation controlling circuit 42B described in the third embodiment. The refrigerant circulation controlling circuit 42D has the controlling functions of the refrigerant circulation controlling circuit 42 and the controlling functions of the refrigerant circulation controlling circuit 42B. In other words, a first refrigerant circulation control, which stops the output of the refrigerant circulation impeding command signal during the predetermined time period $t_1$ from when the engine is started, and a periodic second refrigerant circulation control, which outputs the refrigerant circulation impeding command signal during the predetermined time period $t_3$ after stopping the output of the refrigerant circulation impeding command signal during the predetermined time period $t_2$ when the engine is running, are executed together.

If only the first refrigerant circulation control is carried out, there is a possibility of insufficient lubrication when the engine is operated for a long period of time with the operation switch 40 turned off. The time period of the refrigerant circulation subsequent to the starting of the engine may be prolonged to solve this problem. However, this may cause frost formation in the evaporator 38. On the other hand, if only the second refrigerant circulation control is carried out, there is a possibility of insufficient lubrication immediately after the engine is started. These problems are solved by combining the first and second circulation refrigerant controls.

Figure 17:
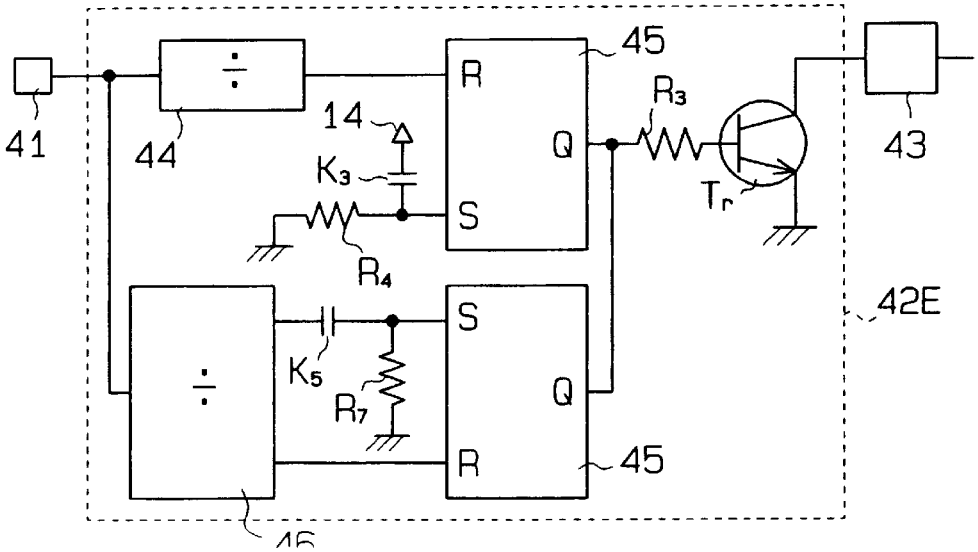
FIG. 17 is a circuit diagram of a refrigerant circulation controlling circuit according to a sixth embodiment.

A sixth embodiment will hereafter be described with reference to FIG. 17. In this embodiment, a refrigerant circulation controlling circuit 42E, which is a combination of the refrigerant circulation controlling circuit 42A described in the second embodiment and the refrigerant circulation controlling circuit 42C described in the fourth embodiment The refrigerant circulation controlling circuit 42E has the controlling functions of the refrigerant circulation controlling circuit 42A and the controlling functions of the refrigerant circulation controlling circuit 42C. In other words, a first refrigerant circulation control, which stops the output of the refrigerant circulation impeding command signal during the time period from when the engine is started until when the predetermined revolution value $N_1$ is reached, is performed together with a periodic second refrigerant circulation control, which outputs the refrigerant circulation impeding command signal until the predetermined revolution value $N_2$ is reached after stopping the output of the refrigerant circulation impeding command signal until the predetermined revolution value $N_3$ is reached when the engine is running. Accordingly, lubrication is ensured in this embodiment in the same manner as the fifth embodiment.

Figure 18:
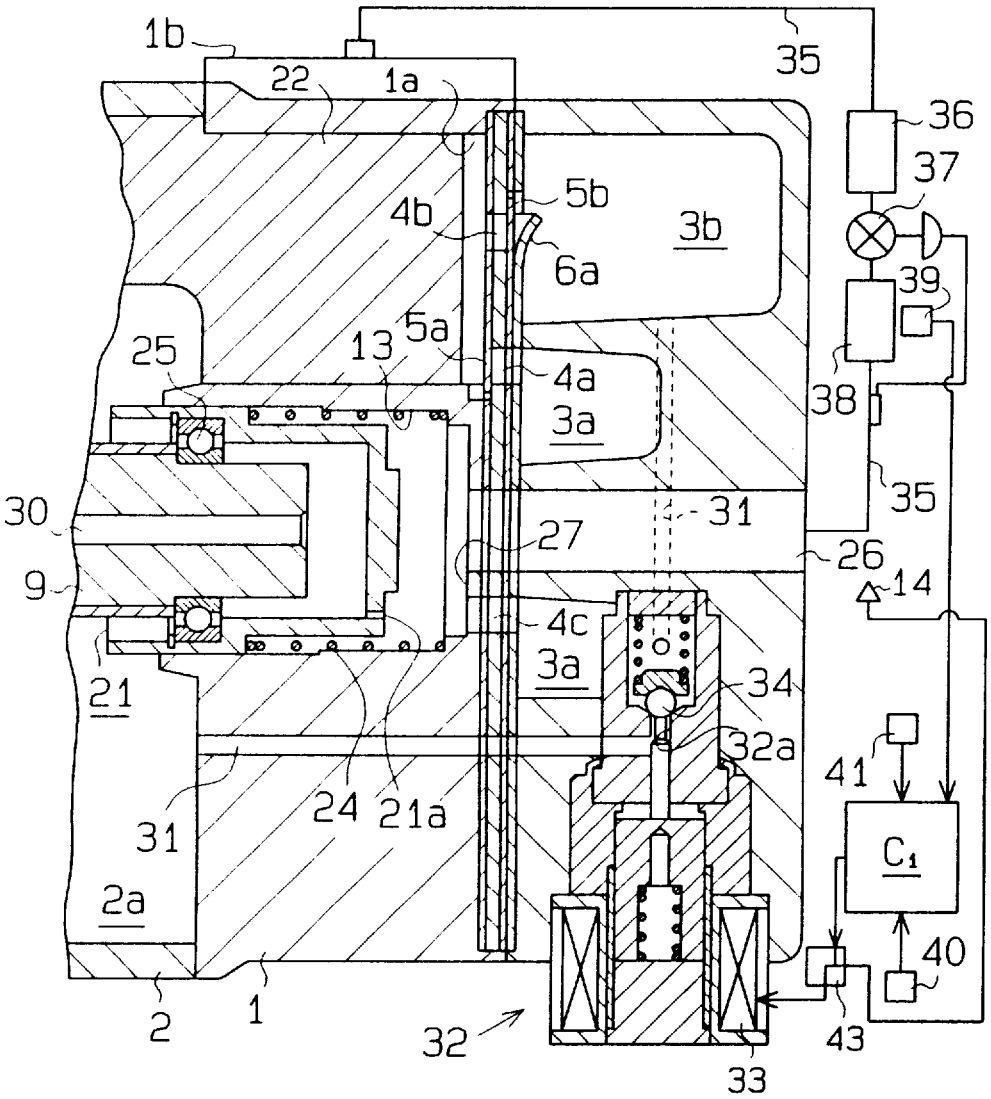
FIG. 18 is a partial cross-sectional view showing a further embodiment of the compressor.
Figure 19:
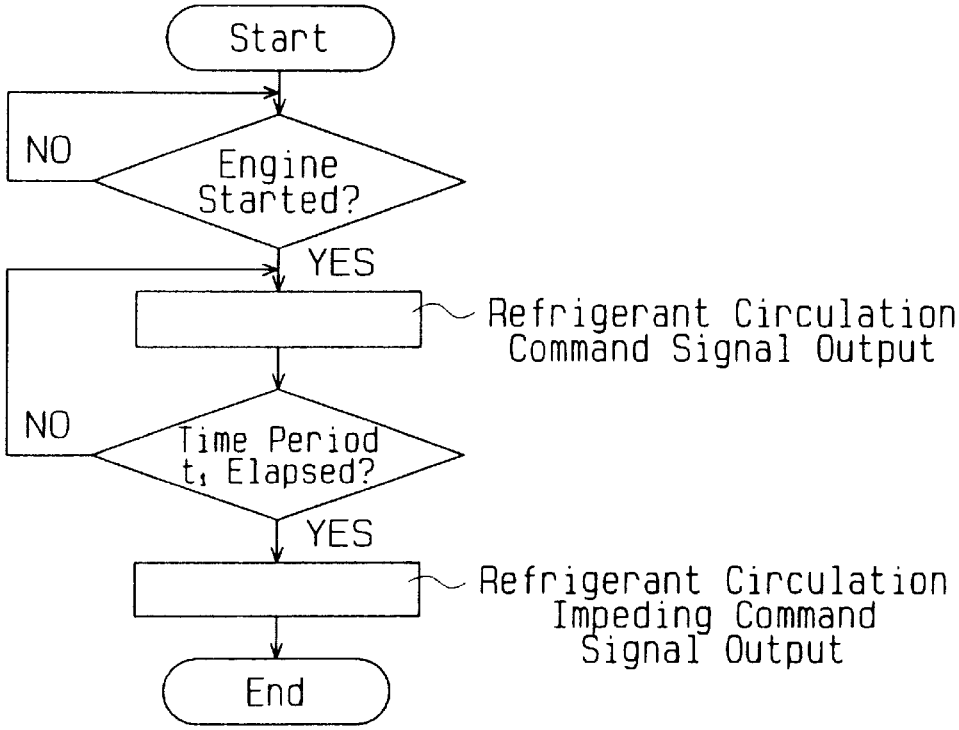
FIG. 19 is a flow chart illustrating a refrigerant circulation control program.
Figure 20:
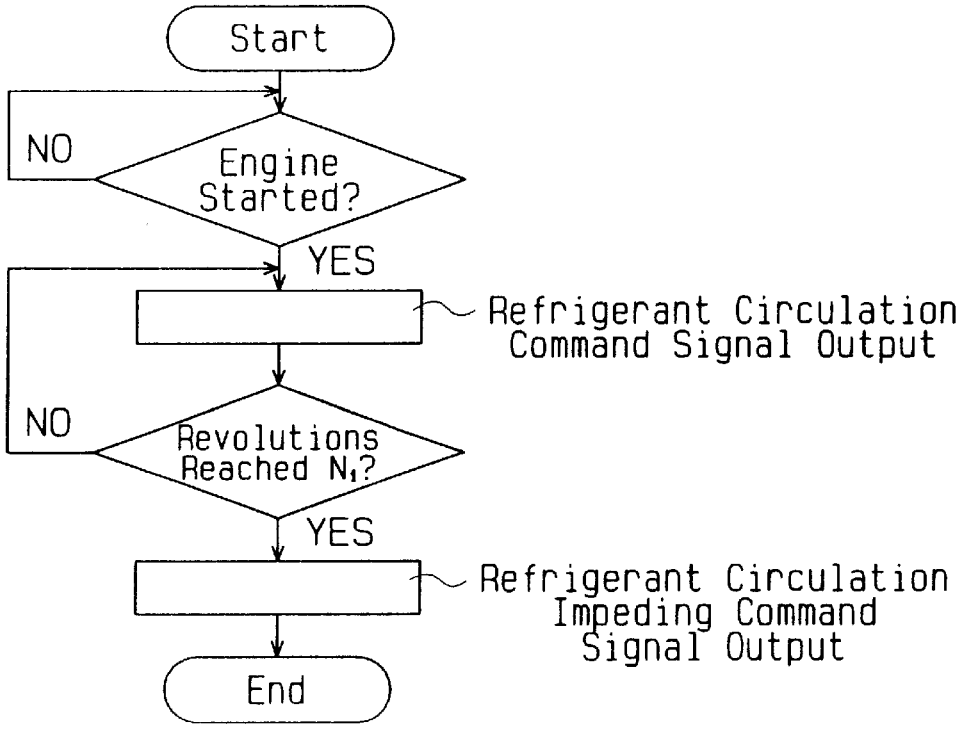
FIG. 20 is a flow chart illustrating the refrigerant circulation control program.
Figure 21:
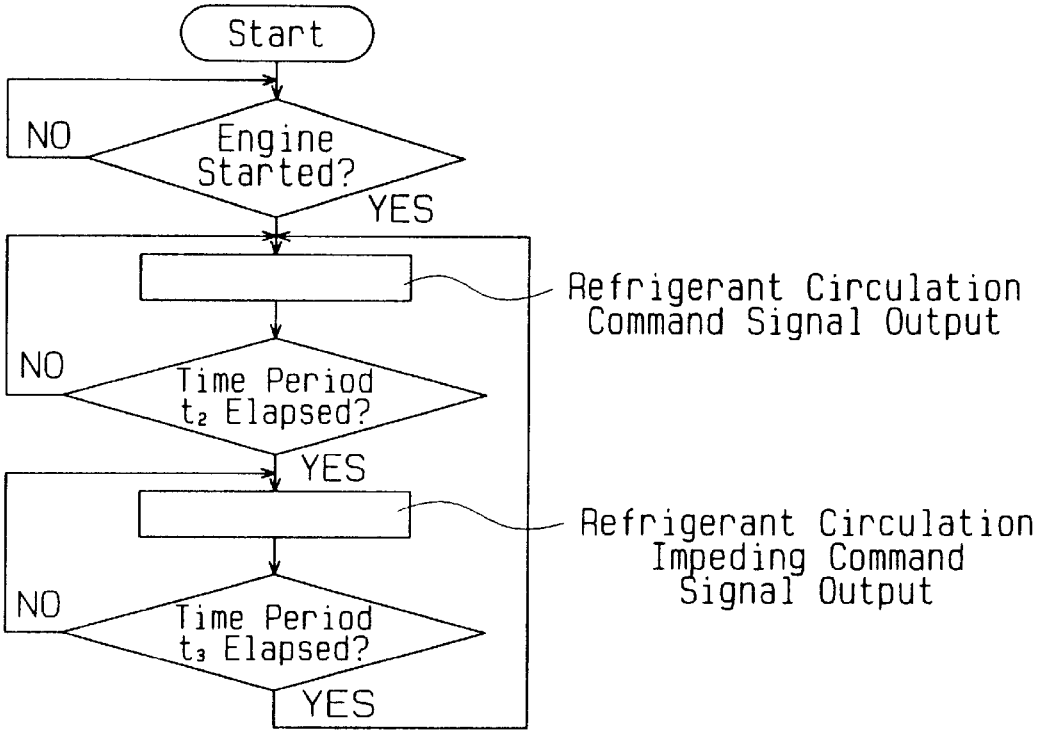
FIG. 21 is a flow chart illustrating the refrigerant circulation control program.
Figure 22:
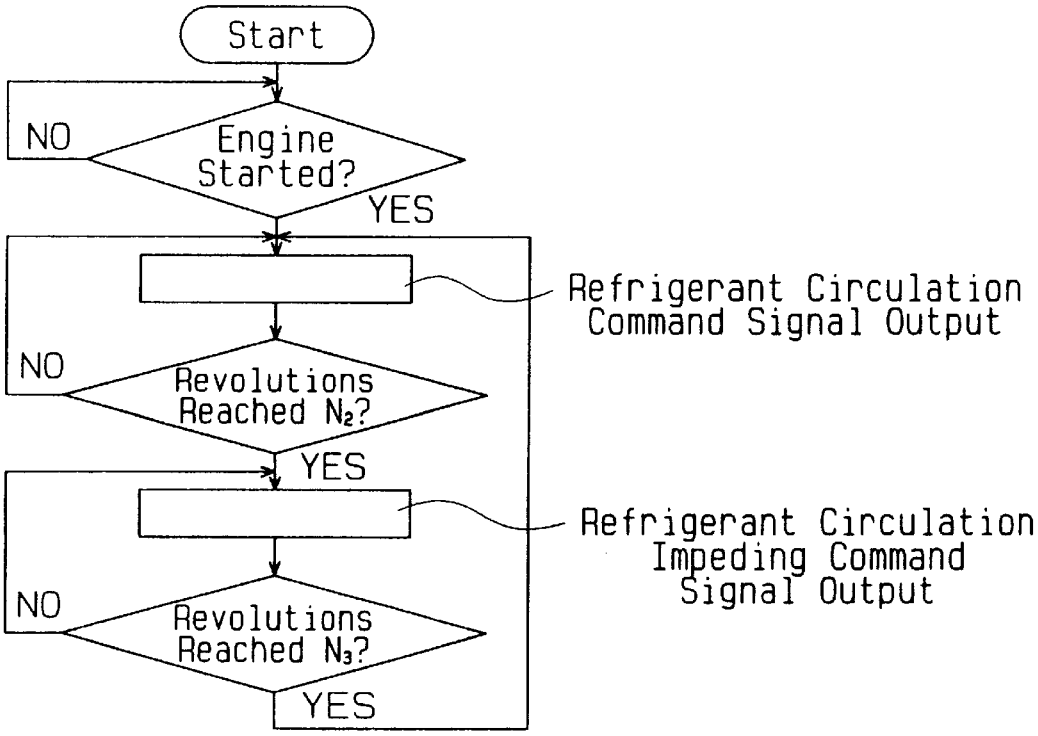
FIG. 22 is a flow chart illustrating the refrigerant circulation control program.

In the embodiment shown in FIG. 18, control computer $C_1$ program controls the refrigerant circulation when the electric source 14 is activated. The flow charts shown in FIGS. 19, 20, 21, and 22 are examples of refrigerant circulation control programs. The control program shown in FIG. 19 corresponds to the refrigerant circulation control of the first embodiment and the control program shown in FIG. 20 corresponds to the refrigerant circulation program of the second embodiment. The control program shown in FIG. 21 corresponds to the refrigerant circulation control of the third embodiment and the control program shown in FIG. 22 corresponds to the refrigerant circulation program of the fourth embodiment. The control computer $C_1$ of the embodiments illustrated in FIGS. 19 and 21 has a time measuring function. The control computer $C_1$ controls the output of the refrigerant circulation command signal and the refrigerant circulation impeding command signal based on the measured time. The control computer $C_1$ of the embodiments illustrated in FIGS. 20 and 22 controls the output of the refrigerant circulation command signal and the refrigerant circulation impeding command signal based on the revolution data from the speed detector 41. The output of the refrigerant circulation command signal corresponds to the stopping of the output of the refrigerant circulation impeding command signal.

As may be anticipated, in addition to these control programs, control programs corresponding to the fifth and sixth embodiments may be constructed. In such control programs, the selection and alteration of the time periods $t_1$, $t_2$, $t_3$ and revolution values $N_1$, $N_2$, $N_3$ are simplified.

Figure 23A:
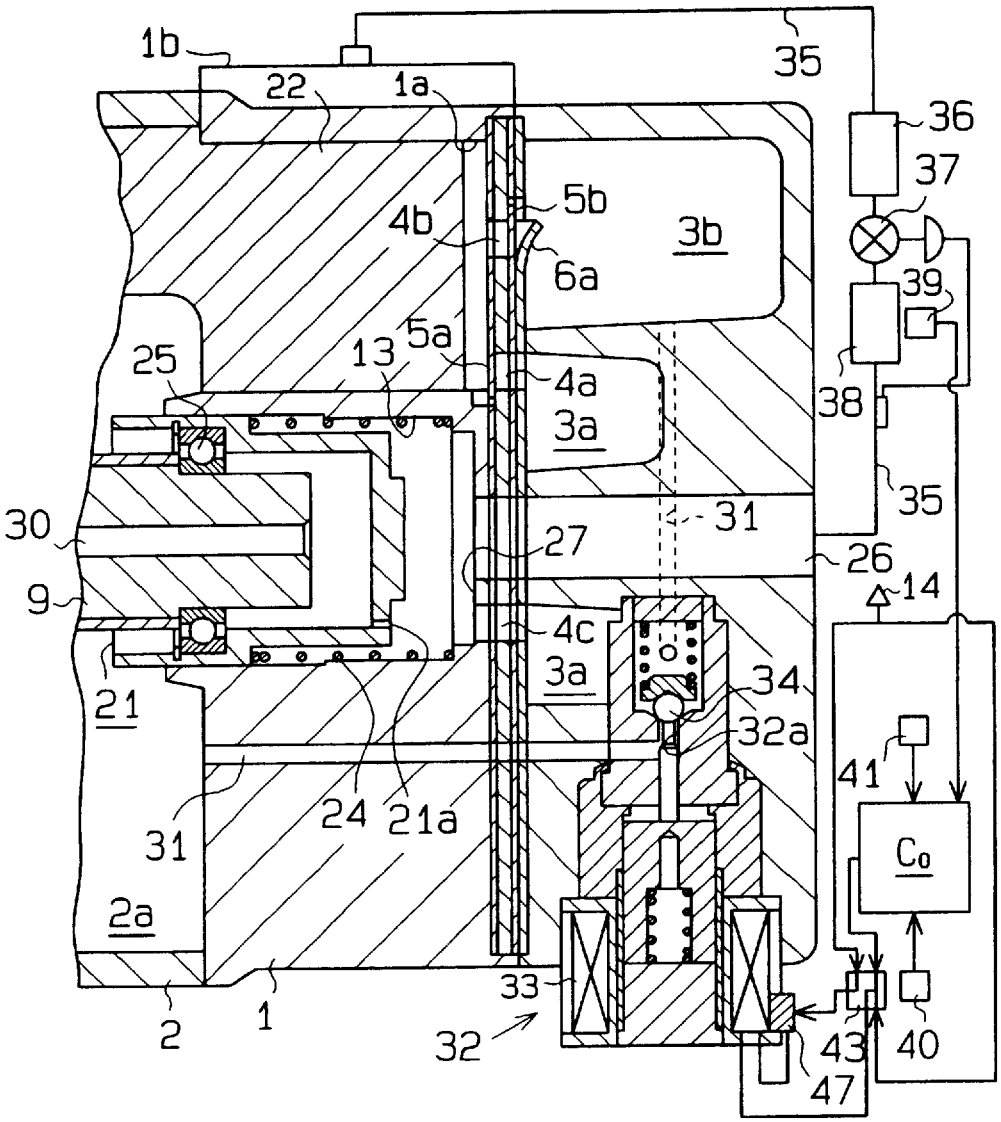
FIG. 23(*a*) is a partial cross-sectional view showing a different embodiment.
Figure 23B:
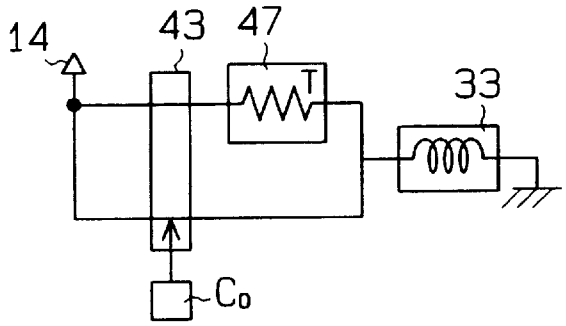

An embodiment according to the present invention shown in FIGS. 23(*a*) and (*b*) may also be carried out. As shown in FIG. 23 (*a*), a positive temperature coefficient thermistor 47 is heat connected to the solenoid 33 of the electromagnetic valve 32. FIG. 23(*b*) shows a schematic circuit diagram showing the electrical connection relationship between the electric source 14, the thermistor 47, and the solenoid 33. The solenoid 33 and the thermistor 47 are series connected to the electric source 14. When the electric source 14 is activated, the solenoid 33 is energized to perform refrigerant circulation. As time elapses, the temperature of the solenoid 33 increases. This raises the temperature of the thermistor 47 heat connected to the solenoid 33. When the temperature of the thermistor 47 exceeds a certain value, resistance increases suddenly. The sudden increase in resistance causes the supply of electric current to become insufficient. This opens the electromagnetic valve 32. In other words, refrigerant circulation is impeded after a certain period of time elapses subsequent to the starting of the engine. Accordingly, lubrication is ensured in this embodiment in the same manner as in the first and second embodiment.

Figure 24:
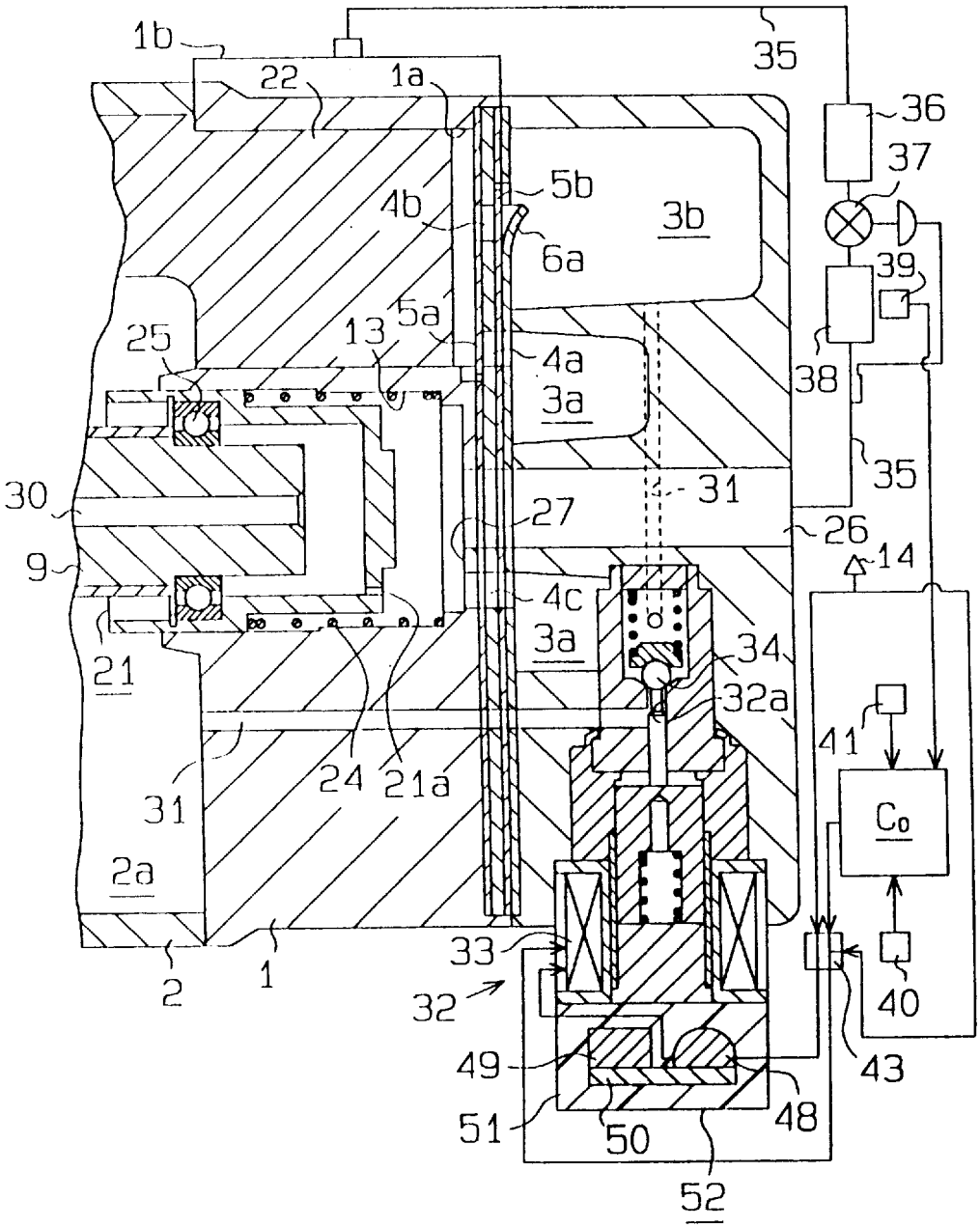
FIG. 24 is a partial cross-sectional view showing a different embodiment.

In the embodiment illustrated in FIG. 24, a flashing switch 52 is constituted by wrapping an insulating material 51 around a heat detecting switch 48, an electric resistor 49, and a thermal conductor 50. The flashing switch 52 is located between the electric source 14 and the solenoid 33. The heat detecting switch 48 is heat connected to the electric resistor 49 by the thermal conductor 50. A metal having high thermal conductivity such as aluminum or copper may be used as the thermal conductor 50. Resin having superior thermal insulating performance may be used as the heat insulating material 51. The wrapping constitution is advantageous from the aspects of stabilizing movement and durability of the flashing switch 52.

Figure 25:
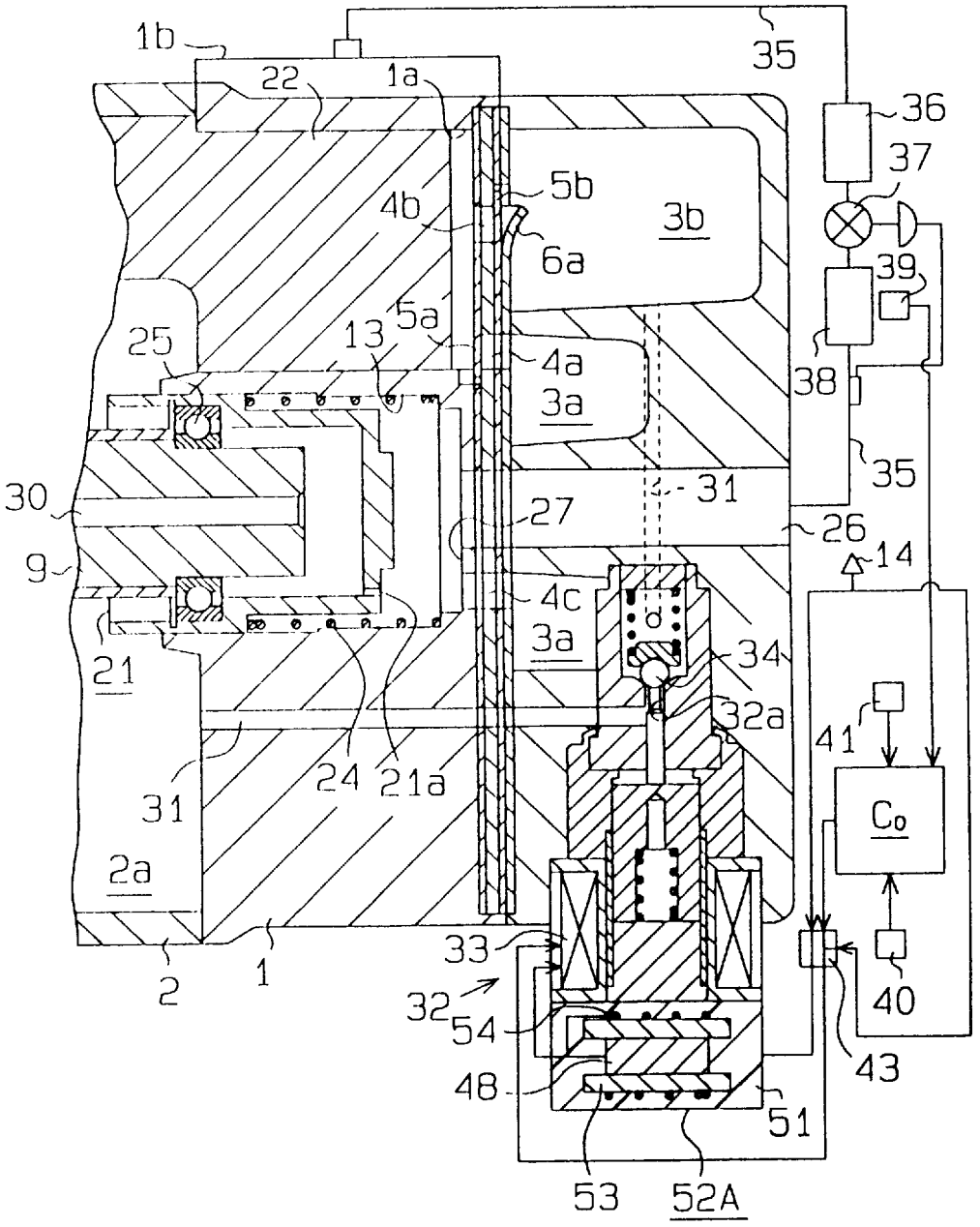
FIG. 25 is a partial cross-sectional view showing a different embodiment.

In the embodiment illustrated in FIG. 25, the detecting switch 48 is retained in a ceramic tube 53, which has high thermal conductivity. An electric resistor wire 54 is wound about the peripheral surface of the cylinder 53. A detecting switch 52A constituted by wrapping these parts with an insulating material is located between the electric source 14 and the solenoid 33. The detecting switch 48 is heat connected to the electric resistor wire 54 by way of the cylinder 53.

Figure 26:
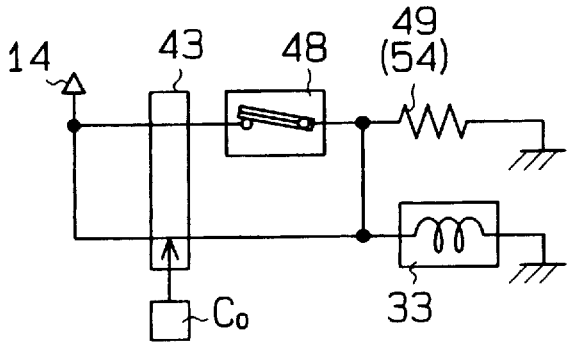
FIG. 26 is a circuit diagram corresponding to FIGS. 24 and 25.
Figure 27:
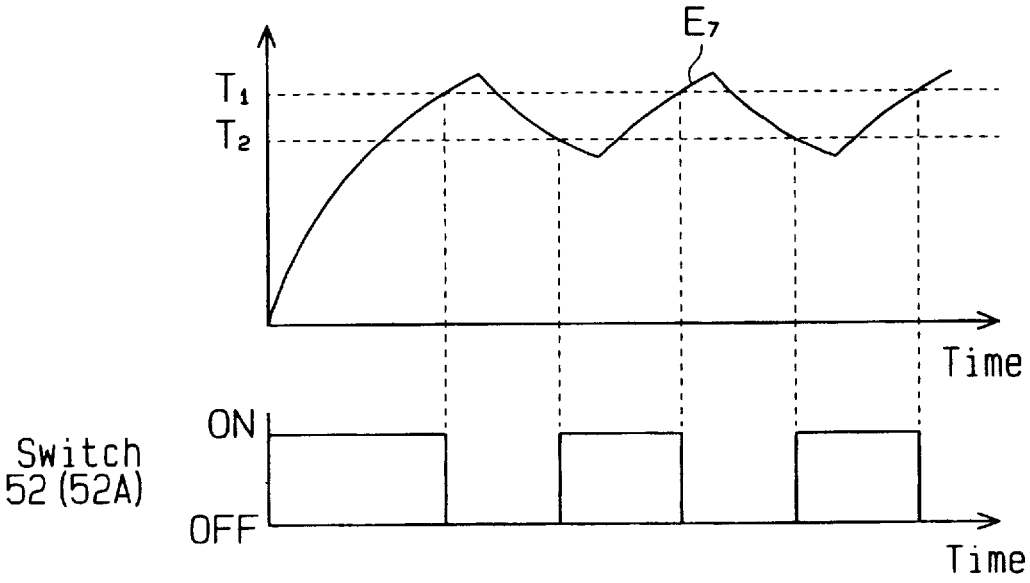
FIG. 27 is a graph illustrating the refrigerant circulation control.

FIG. 26 illustrates a schematic circuit diagram indicating the electrical connection relationship between the electric source 14, the heat detecting switch 48, the electric resistor 49 (or the electric resistor wire 54) and the solenoid 33. The solenoid 33 and the heat detecting switch 48 are series connected to the electric source 14. The solenoid and the electric resistor 49 (or the electric resistor wire 54) are parallel connected to the heat detecting switch 48. Activation of the electric source 14 energizes the solenoid 33 and causes refrigerant circulation. As time elapses, the temperature of the electric resistor 49 (or the electric resistor wire 54) increases. This increases the temperature of the heat detecting switch 48 which is heat connected to the electric resistor 49 (or the electric resistor wire 54). As shown in FIG. 27, the heat detecting switch 48 is turned off from a state in which it had been turned on when curve $E_7$ reaches temperature $T_1$. The heat detecting switch 48 is turned on from a state in which it had been turned off when reaching temperature $T_2$. In other words, the flashing switches 52, 52A repeat ON/OFF actions. This repetitively opens and closes the electromagnetic valve 32. Accordingly, refrigerant circulation is repeated periodically when the engine is operated with the operation switch 40 kept turned off. Additionally, lubrication is ensured in the same manner as in the third and fourth embodiment.

Figure 28:
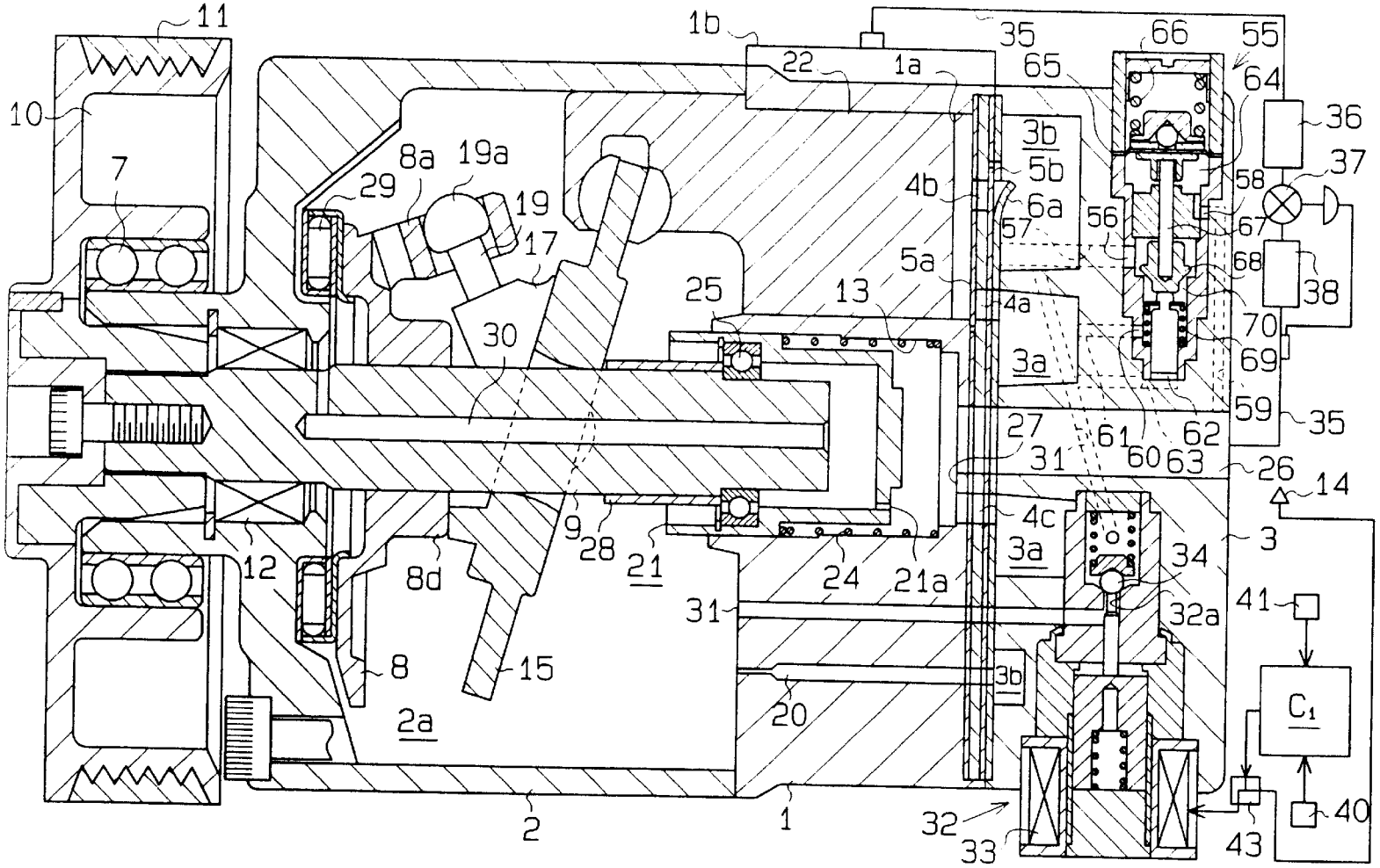
FIG. 28 is a cross-sectional side view showing a compressor according to another embodiment.
Figure 29:
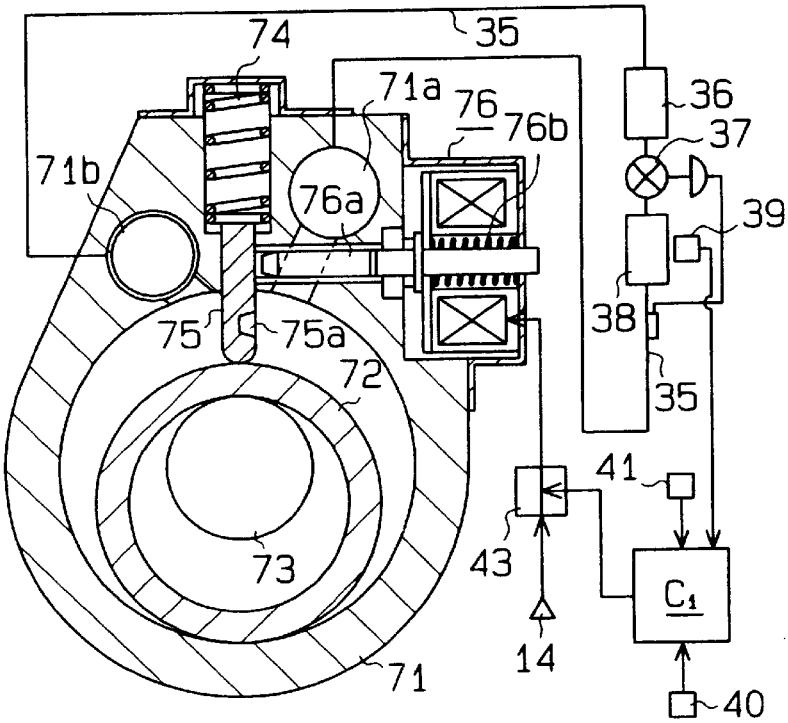
FIG. 29 is a cross-sectional view showing a rotary compressor according to another embodiment.
Figure 30:
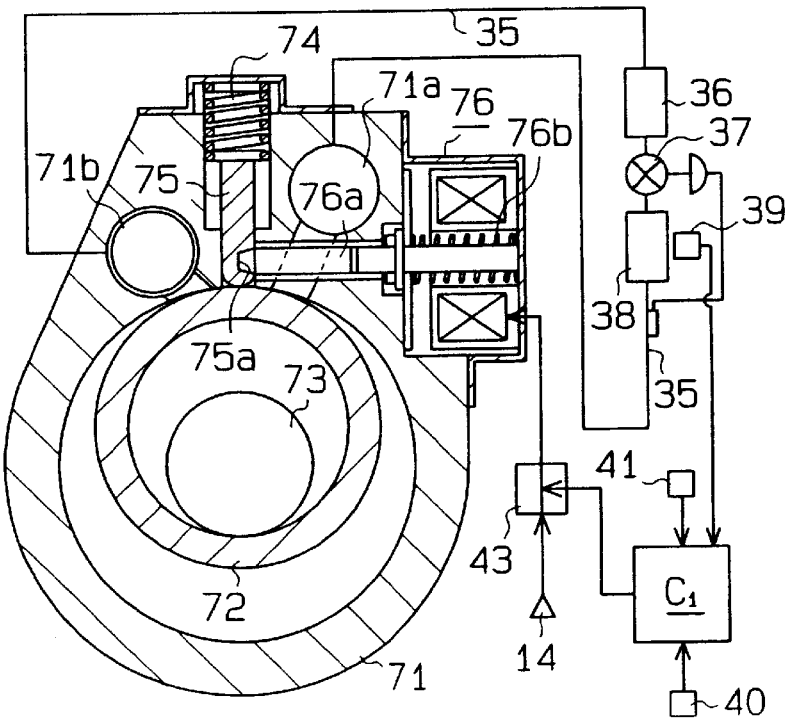
FIG. 30 is a cross-sectional view showing the compressor in a state in which refrigerant circulation is impeded.

The present invention may be employed in a clutchless compressor illustrated in FIG. 28 and a rotary type clutchless compressor illustrated in FIGS. 29 and 30.

In the compressor shown in FIG. 28, the pressure in the crank chamber 2*a* is controlled by a displacement valve 55. A released pressure intake port 56 of the displacement control valve 55 is connected to the crank chamber 2*a* through a passageway 57. A suction pressure intake port 58 is connected to the suction passage 26 through a suction pressure intake passageway 59. A released pressure port 60 is connected to the suction chamber 3*a* through a passageway 61. A discharge pressure intake port 62 is connected to the discharge chamber 3*b* through a discharge pressure intake passageway 63. The pressure in a suction pressure detection chamber 64, which leads to the suction pressure intake port 62 counteracts an adjustment spring 66 by way of a diaphragm 65. The spring force of the adjustment spring 66 is transmitted to the valve body 68 through the diaphragm 65 and a rod 67. The valve body 68, which a return spring 69 acts upon, opens and closes a valve hole 70 in accordance with the alteration of the suction pressure in the suction pressure detecting chamber 64. The opening and closing causes the released pressure intake port 56 to be connected to and disconnected from the released pressure port 60.

The suction chamber 3*b* and the crank chamber 2*a* are connected to each other through a restriction passage 20.

When the solenoid 33 is energized to close the pressurizing passage 31, the area opened by the valve body 68 is large when the suction pressure is high (the cooling load is large). This increases the flow rate of the refrigerant gas flowing into the suction chamber 3*a* from the crank chamber 2*a*. As a result, the pressure in the crank chamber 2*a* decreases and the swash plate inclination increases. Contrarily, the area opened by the valve body 68 is small when the suction pressure is low (the cooling load is small). This decreases the flow rate of the refrigerant gas flowing into the suction chamber 3*a* from the crank chamber 2*a*. Accordingly, the pressure in the crank chamber 2*a* increases and the swash plate inclination decreases. In other words, displacement is variably controlled continuously.

In the compressor shown in FIGS. 29 and 30, rotation of a drive shaft 73 eccentrically rotates a rotor 72 inside a cylinder 71. A vane 75 is projectable from the inner surface of the cylinder 71 and urged toward the rotor 72 by a spring 74. An electromagnetic actuator 76 is provided in the cylinder 71. When the electromagnetic actuator 76 is energized, a drive pin 76*a* moves away from the side surface of the vane 75. This causes the vane 75 to project from the inner surface of the cylinder 71. Accordingly, the refrigerant gas in the external refrigerant circuit 35 is drawn into the cylinder 71 through a suction passage 71*a*. The refrigerant gas in the cylinder 71 is discharged into the external refrigerant circuit 35 through a discharge passage 71*b*. In other words, refrigerant circulation is performed.

When the electromagnetic actuator 76 is de-energized, the drive pin 76*a* is pressed against the side surface of the vane 75 by the urging force of the spring 76*b*. An engaging hole 75*a* is formed in the side surface of the vane 75*a*. The drive pin 76*a* enters the hole 75*a* when the electromagnetic actuator 76 is de-energized and causes the vane 75 to be located at a position shown in FIG. 30. This impedes refrigerant circulation. In other words, the electromagnetic actuator 75 constitutes a refrigerant circulation impeding means.

In the embodiment illustrated in FIG. 28 and the embodiment illustrated in FIGS. 29 and 30, the control computer $C_1$ program controls the refrigerant circulation when the electric source 14 is activated and ensures lubrication in the compressor in the same manner as the embodiment shown in FIG. 18. It is apparent that a refrigerant circulation control structure described in the first through sixth embodiments and the embodiments shown in FIGS. 23 and 24 may be used in the compressor illustrated in FIG. 28 and the compressor illustrated in FIGS. 29 and 30.

Figure 31:
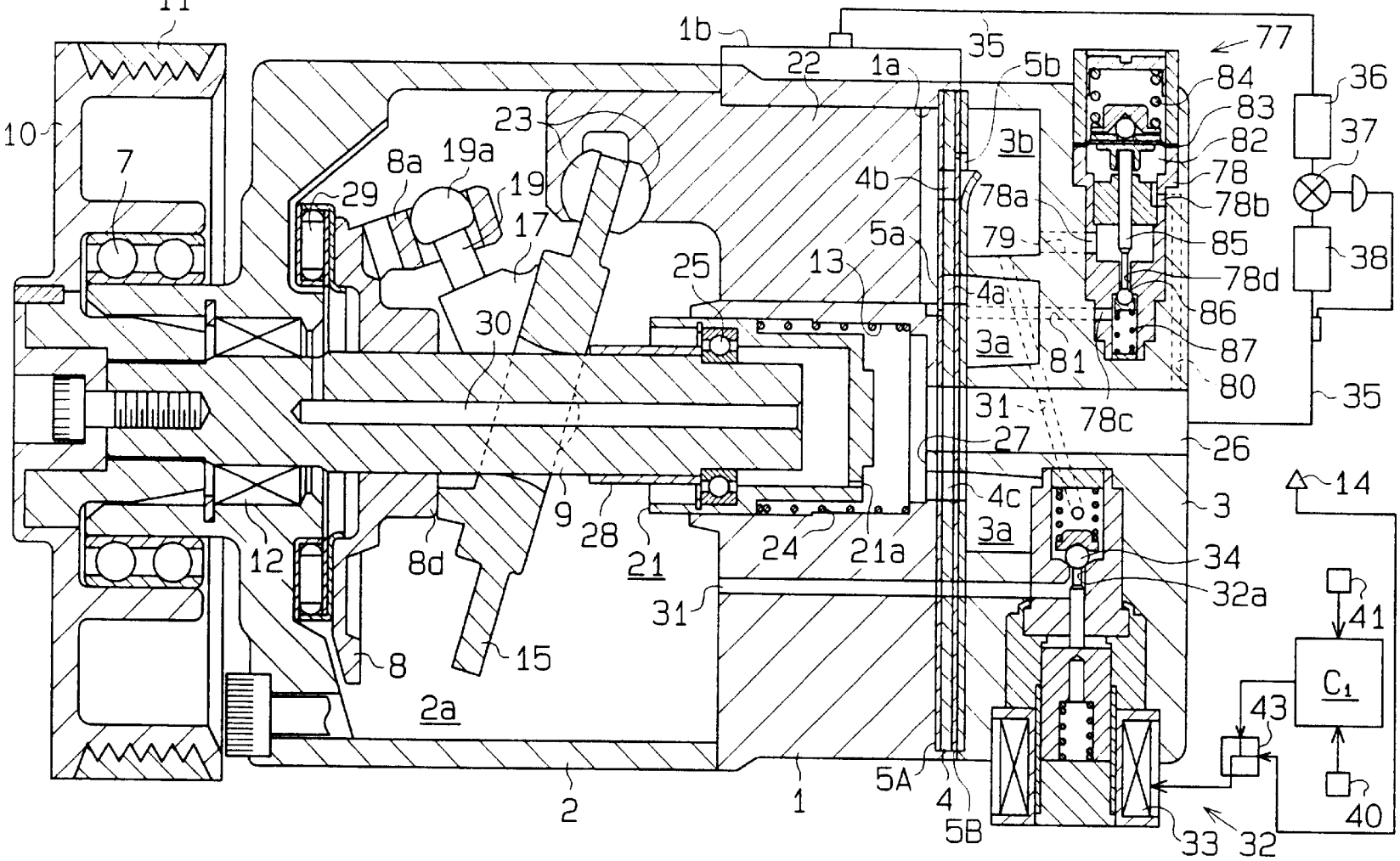
FIG. 31 is a cross-sectional side view showing a compressor according to another embodiment.

An embodiment illustrated in FIG. 31 will hereafter be described. Parts that are identical to parts illustrated in FIG. 28 are denoted with the same reference numerals and will not be described in detail. In this embodiment, a displacement control valve 77 is provided in the rear housing 3. The pressure in the crank chamber 2*a* is controlled by the displacement control valve 77. A valve housing 78, which constitutes the displacement control valve 77 includes a discharge pressure intake port 78*a*, a suction pressure intake port 78*b*, and a released pressure port 78*c*. The discharge pressure intake port 78*b* is connected to the suction chamber 3*b* through a passageway 79. The suction passage intake port 78*b* is connected to the suction passage 26 by a suction pressure intake passageway 80. The released pressure port 78*c* is connected to the crank chamber 2*a* through a passageway 81.

The pressure in a suction pressure detection chamber 82, which leads to the suction pressure intake port 78*b*, counteracts an adjustment spring 84 by way of a diaphragm 83. The spring force of the adjustment spring 84 is transmitted to the valve body 86 through the diaphragm 83 and a rod 85. The force of a return spring 87 acts on the valve body 86. The force applying direction of the return spring 87 with respect to the valve body 86 corresponds to a direction closing the valve hole 78*d*. The valve body 86, which the return spring acts upon, opens and closes a valve hole 78*d* in accordance with the alteration of the suction pressure in the suction pressure detecting chamber 82.

When the solenoid 33 is energized to close the pressurizing passage 31, the valve body 86 closes if the suction pressure becomes high (the cooling load is large). This closes a pressurizing path defined extending through the discharge chamber 3*b*, the passageway 79, the displacement control valve 77, and the passageway 81. The pressure in the crank chamber 2*a* decreases due to the refrigerant gas in the crank chamber 2*a* flowing into the suction chamber 3*a* via the conduit 30 and the pressure releasing hole 21*a*. In addition, since the suction pressure in the cylinder bores 1*a* is high, the difference between the pressure in the crank chamber 2*a* and the suction pressure in the cylinder bores 1*a* becomes small. This increases the inclination of the swash plate 15.

Contrarily, the area opened by the valve body 86 becomes large if the suction pressure becomes low (the cooling load is small). This increases the flow rate of the refrigerant gas flowing into the crank chamber 2*a* from the discharge chamber 3*b*. Accordingly, the pressure in the crank chamber 2*a* increases. Additionally, since the suction pressure in the cylinder bores 1*a* is low, the difference between the pressure in the crank chamber 2*a* and the suction pressure in the cylinder bores 1*a* becomes large. Thus, the inclination of the swash plate 15 becomes small.

The area opened by the valve body 86 becomes maximum when the suction pressure is extremely small (there is no cooling load). This increases the pressure in the crank chamber 2*a* and inclines the swash plate 15 toward the minimum inclination. Furthermore, the pressurizing passage 31 is opened when the solenoid 33 is de-energized. When the solenoid 33 is energized, the pressurizing passage 31 closes.

In other words, in this embodiment, the swash plate inclination is variably controlled continuously. In this embodiment, the control computer $C_1$ executes any one of the refrigerant circulation control programs illustrated in the flowcharts in FIGS. 19 through 22 in accordance with the revolution data from the speed detector 41. Additionally, the de-energizing signal sent to the electromagnetic valve 32 from the control computer $C_1$ corresponds to a refrigerant circulation impeding command signal. Again, in the clutchless compressor of this embodiment, the control computer $C_1$ program controls the refrigerant circulation when the electric source 14 is activated and ensures lubrication in the compressor.

The swash plate inclination controlling responsiveness is high when the displacement is controlled by controlling the flow rate of the refrigerant gas supplied to the crank chamber 2*a* from the discharge chamber 3*b* in comparison to when the displacement is controlled by controlling the flow rate of the refrigerant gas released into the suction chamber 3*a* from the crank chamber 2*a* as shown in FIG. 28. This is because the refrigerant gas supplied to the crank chamber 2*a* is high pressure discharged refrigerant gas.

Figure 32:
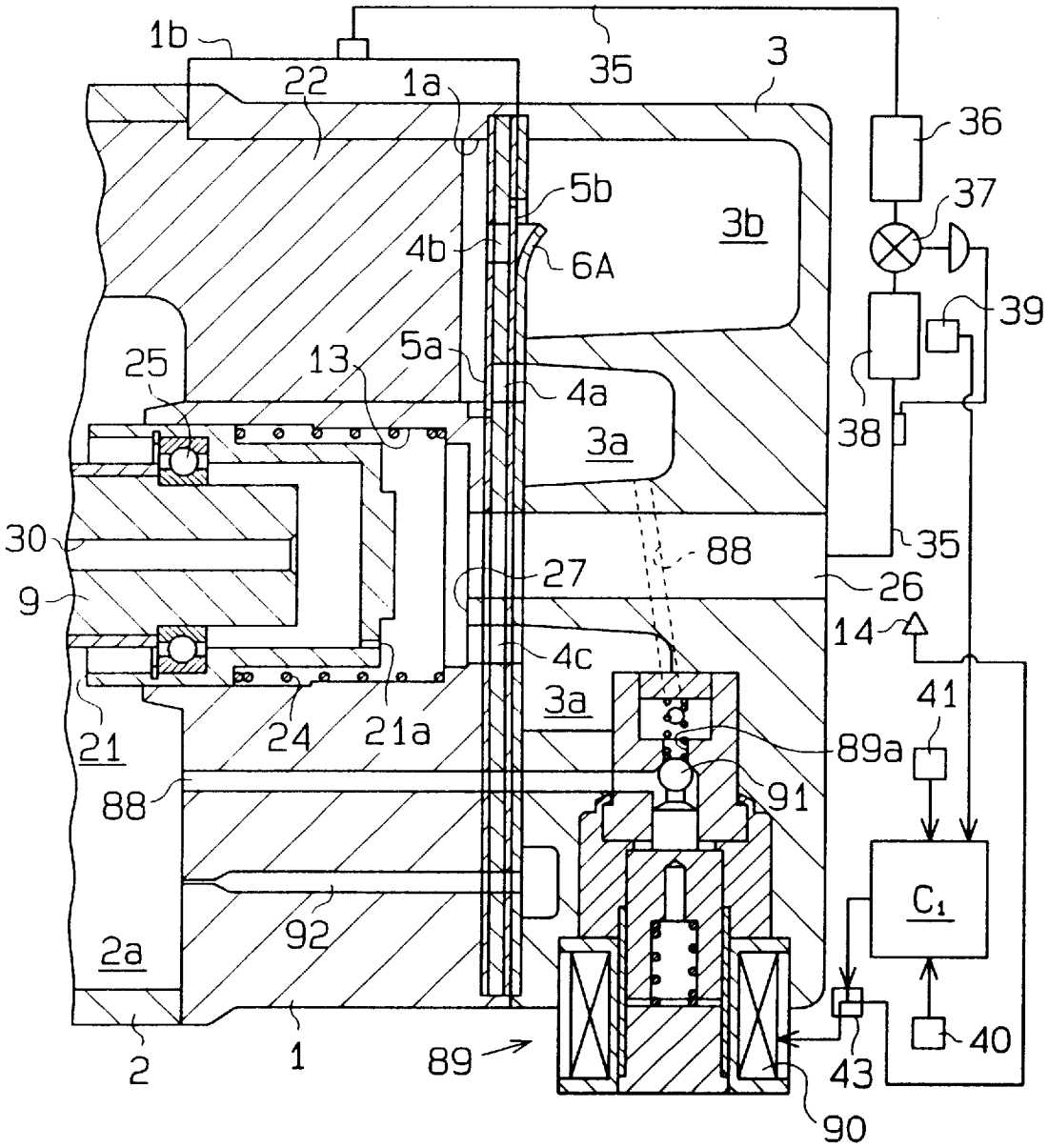
FIG. 32 is a partial cross-sectional view showing another embodiment.
Figure 33:
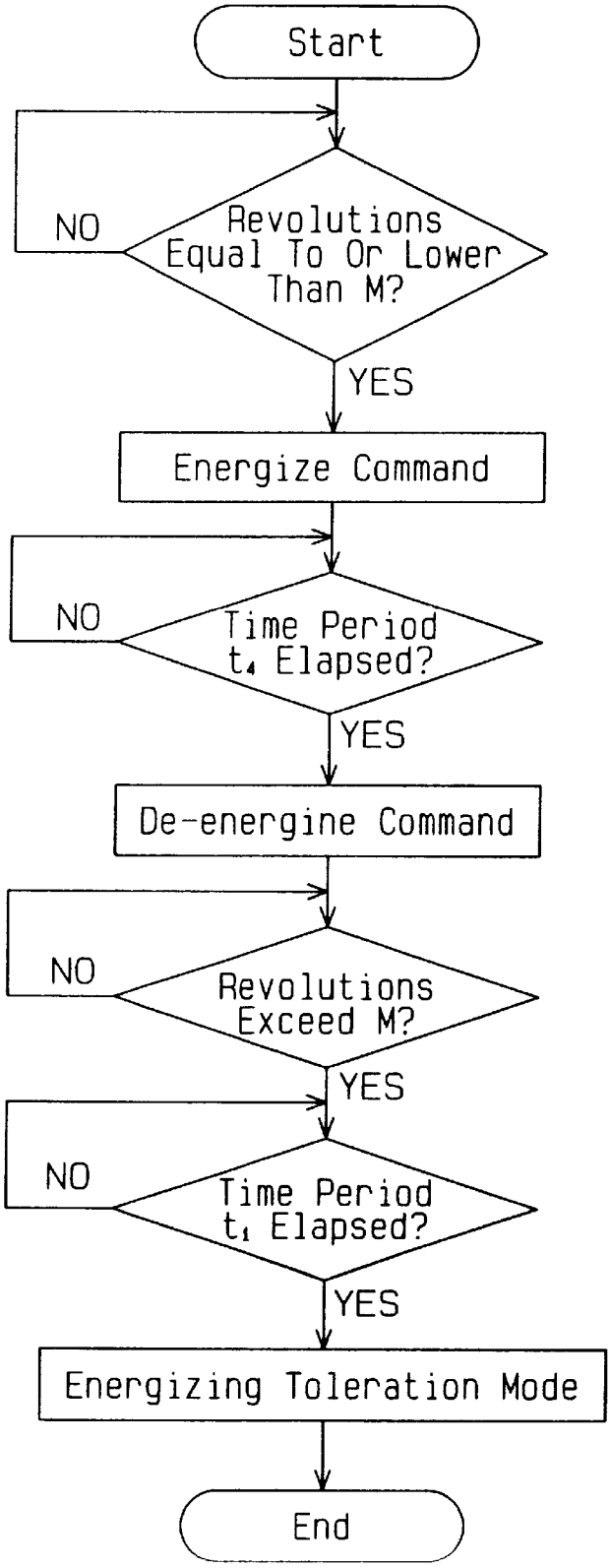
FIG. 33 is a flow chart illustrating the refrigerant circulation controlling program.

The embodiment illustrated in FIGS. 32 and 33 will hereafter be described. Parts that are identical to parts illustrated in FIG. 18 are denoted with the same reference numerals and will not be described in detail. The crank chamber 2*a* and the suction chamber 3*a* are connected by a pressure releasing passageway 88. An electromagnetic valve 89 is provided in the pressure releasing passageway 88. When a solenoid 90 of the electromagnetic valve 89 is energized, a valve body 91 opens a valve hole 89*a*. When the solenoid 90 is de-energized, the valve body 91 closes the valve hole 89*a*. The discharge chamber 3*b* and the crank chamber 2*a* are connected to each other by a pressurizing passage 92. The refrigerant gas in the discharge chamber 3*b* is constantly supplied to the crank chamber 2*a* through the pressurizing passage 92.

When the temperature detected by the temperature sensor 39 becomes equal to or lower than a predetermined value, the control computer $C_1$ de-energizes the solenoid 90. When the solenoid 90 is de-energized, the pressure releasing passageway 88 is closed and the suction chamber 3*a* becomes disconnected from the crank chamber 2*a*. Accordingly, the refrigerant gas stops flowing through the pressure releasing passageway 88 from the crank chamber 2*a* to the suction chamber 3*a* and increases the pressure in the crank chamber 2*a*. The pressure increase in the crank chamber 2*a* causes the swash plate 15 to incline toward the minimum inclination. When the temperature detected by the temperature sensor 39 exceeds the predetermined value, the control program energizes the solenoid 90. When the solenoid 90 is de-energized, the pressure releasing passageway 88 is opened. The difference between the pressure in the crank chamber 2*a* and the pressure in the suction chamber 3*a* causes pressure in the crank chamber 2*a* to be reduced as pressure is released through the pressure releasing passageway 88. The pressure decrease inclines the swash plate 15 from the minimum inclination to the maximum inclination.

The control computer $C_1$ executes a refrigerant circulation control program illustrated in FIG. 33 in accordance with the revolution data from the speed detector 41. When the engine is stopped and the revolution per unit time detected by the speed detector 41 becomes lower than a predetermined revolution value M, the control computer $C_1$ energizes the electromagnetic valve 89. This opens the pressure releasing passageway 88 and inclines the swash plate 15 toward the minimum inclination. The energizing of the electromagnetic valve 89 continues during time period $t_4$ which is longer than the time period required for the swash plate 15 to incline to the minimum inclination. The computer $C_1$ then de-energizes the electromagnetic valve 89 and closes the pressure releasing passageway 88. When the engine is started and time $t_1$ elapses after the revolutions per unit time detected by the speed detector 41 exceed the predetermined revolution value M, the control computer $C_1$ enters a mode that allows the energizing of the electromagnetic valve 89. During the period in which time period $t_1$ has not yet elapsed, the control computer $C_1$ does not energize the electromagnetic valve 89 even when the temperature detected by the temperature sensor 39 exceeds the predetermined temperature.

In the clutchless compressor of this embodiment, the control computer $C_1$ program controls the refrigerant circulation in accordance with the data of the revolution speed sent from the speed detector 41. This ensures lubrication inside the compressor.

Figure 34:
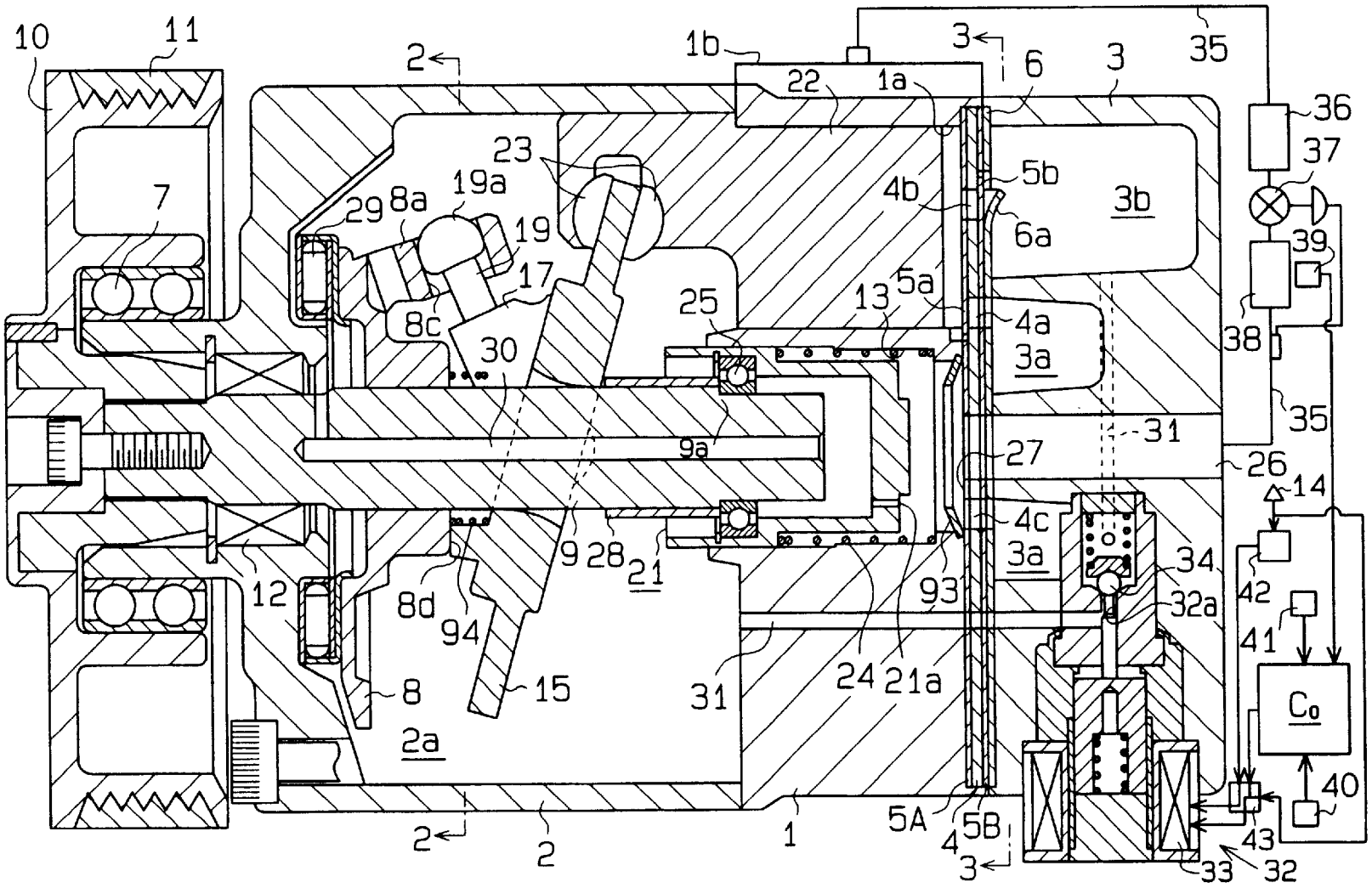
FIG. 34 is a cross-sectional view showing a compressor according to another embodiment.
Figure 35:
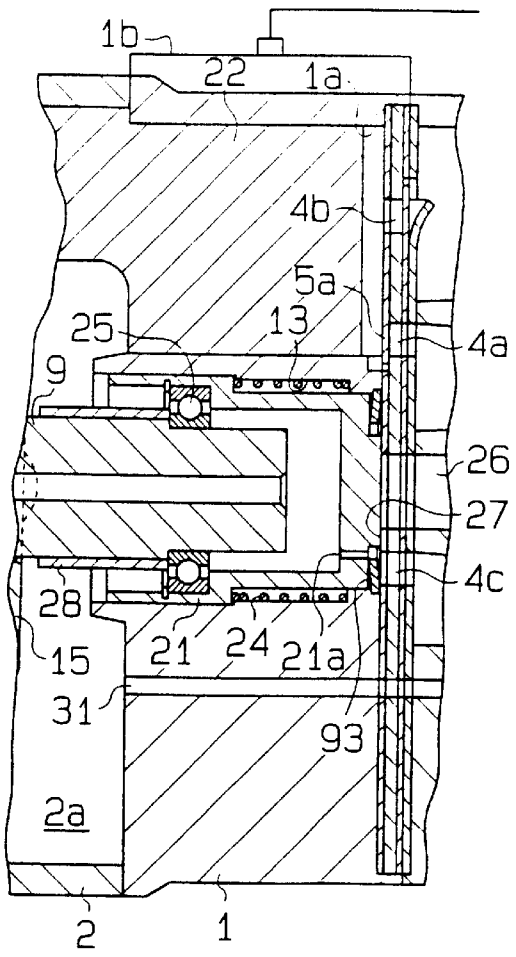
FIG. 35 is a partial cross-sectional side view showing the shutter with the swash plate at a maximum inclination.
Figure 36:
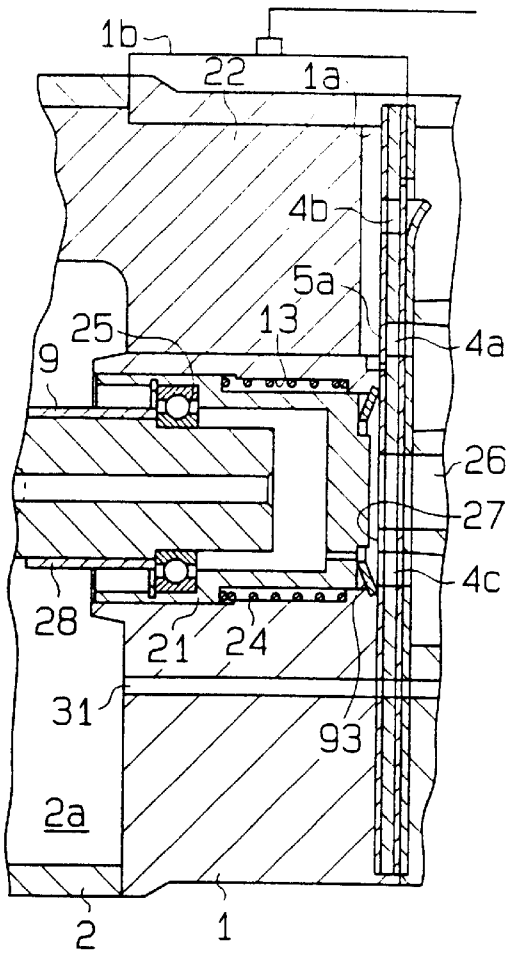
FIG. 36 is a partial cross-sectional side view showing the shutter with the swash plate at a stop inclination.

An embodiment described in FIGS. 34 to 36 will hereafter be described. Parts that are identical to parts illustrated in FIG. 1 are denoted with the same reference numerals and will not be described in detail. In this embodiment, the positioning surface 27 is defined on the valve forming plate 5A and the shutter 21 abuts against the valve forming plate 5A. A compression spring 94 is arranged between the rotary support body 8 and the swash plate 15. The compression spring 94 urges the swash plate 15 toward a direction which its inclination is minimized.

A belleville spring 93 is accommodated in the retaining hole 13. The shutter 21 abuts against the belleville spring 93 before abutting against the positioning surface 27. The shutter 21 causes elastic deformation and flattens the belleville spring 93 to close the suction passage 26. As shown in FIG. 35, when the electromagnetic valve 32 is de-energized and as long as the engine is running, the difference between the pressure in the crank chamber 2*a* and the suction pressure together with the spring force of the compression spring 94 causes the shutter 21 to flatten and deform the belleville spring 93 in an elastic manner to close the suction passage 26. When the engine stops operation and the swash plate 15 stops rotation with the electromagnetic valve 32 in a de-energized state, the spring force of the belleville spring 93 moves the shutter 21 away from the positioning surface 27. Therefore, when the engine is not running, the shutter 21 is separated from the positioning surface 27 and the swash plate 15 is inclined at a stop inclination, which inclination is greater than the minimum inclination.

When the engine starts running, the swash plate 15 starts rotation at the stop inclination. Accordingly, refrigerant circulates in the external refrigerant circuit 35 and ensures lubrication in the compressor. When the engine is started and the electromagnetic valve 32 is simultaneously energized, the belleville spring 93 guarantees immediate refrigerant circulation in the external refrigerant circuit 35 regardless of the swash plate 15 increasing its inclination from the minimum inclination at an extremely slow rate.

Figure 37:
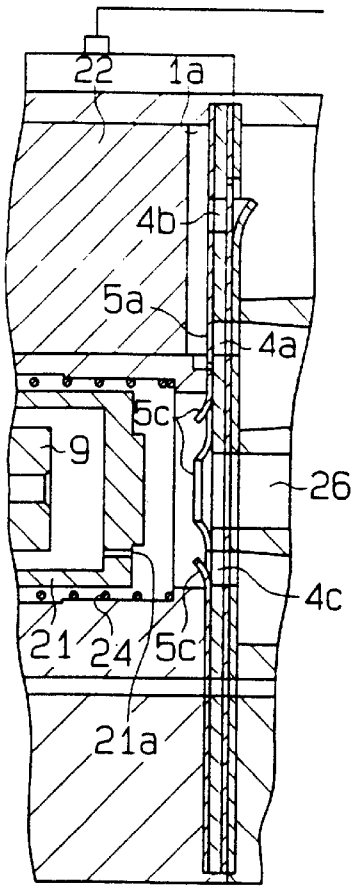
FIG. 37 is a partial cross-sectional view showing another embodiment.

An embodiment described in FIG. 37 will hereafter be described. Parts that are identical to parts illustrated in FIG. 34 are denoted with the same reference numeral and will not be described in detail. In this embodiment, the positioning surface 27 is defined on the valve forming plate 5A, which has the property of a spring. A leaf spring portion 5*c* is defined at the section of the valve forming plate 5A exposed to the inside of the retaining hole 13. The shutter 21 causes elastic deformation and flattens the leaf spring 5*c* to close the suction passage 26. In other words, the leaf spring portion 5*c* substitutes the belleville spring 93 of FIG. 34 and causes the shutter 21 to be separated from the positioning surface 27 when the engine is not running. This inclines the swash plate 15 to the stop inclination. Accordingly, lubrication in the compressor is ensured.

The embodiments illustrated in FIGS. 34 and 37 perform energizing and de-energizing control in a manner such as shown in the flowcharts of FIGS. 19 to 22. However, lubrication in the compressor may be ensured without such energizing and de-energizing control. When the engine starts operation, the swash plate 15 starts rotation at the stop inclination and refrigerant circulates in the external refrigerant circuit 35 even if the electromagnetic valve 32 is not energized. In addition, a difference in the pressures in the discharge chamber 3*b*, the crank chamber 2*a*, and the suction chamber 3*a* takes place. When the difference between the pressure in the crank chamber 2*a* and the pressure in the suction chamber 3*a* becomes great, the swash plate 15 inclines toward the minimum inclination against the spring force of the belleville spring 93. Accordingly, refrigerant circulation is performed when the swash plate 15 inclines from the stop inclination to the minimum inclination. This ensures lubrication in the compressor.

Furthermore, the present invention may be applied to a clutchless compressor, such as the compressor described in, Japanese Unexamined Patent Publication 3-37378, which is provided with a refrigerant circulation impeding means that impedes the flow of refrigerant gas from the external refrigerant circuit to the suction chamber by using an electromagnetic valve.

In addition to the suction chamber 3*a*, the suction pressure zone includes the interior of the retaining hole 13, which is defined by the shutter 21 in the crank chamber 2*a*, and the aperture 4*c*.

In addition to the discharge chamber 3*b*, the discharge pressure zone includes the inside of the outlet 1*b*, and the external refrigerant circuit at the section between the outlet 1*b* and the condenser 36.

Although the present invention has been described in considerable detail with reference to certain preferred versions thereof, other versions are possible. Therefore, the spirit and scope of the appended claims should not be limited to the description of the preferred versions contained herein.

We claim:

1. Apparatus for controlling lubrication of a clutchless compressor, wherein the compressor is driven by a mechanical drive source to compress and recirculate refrigerant in a refrigerant circuit, and wherein the refrigerant includes lubricant for the compressor, the apparatus comprising:

a refrigerant circulation impeding means for impeding refrigerant from circulating in the refrigerant circuit, the impeding means being controllably moved between a circulation-impeding position where refrigerant is impeded from circulation in the refrigerant circuit and a free-circulation position where refrigerant may freely circulate in the refrigerant circuit;

a refrigerant circulation controller for setting the impeding means in its free-circulation position for a predetermined period of time starting from a time of activation of the drive source such that lubrication is positively supplied to the compressor by the refrigerant when the compressor is initially driven after a time of inactivity, and for setting the impeding means in its circulation impeding position when the predetermined period of time elapses.

2. The apparatus according to claim 1, wherein the controller is connected to a sensor for counting the number of revolutions of a rotating member operatively connected to the drive source, and the controller determines the predetermined period of time based on the completion of a predetermined number of revolutions of the rotating member as counted from a time of activation of the drive source.

3. The apparatus according to claim 1, wherein the impeding means includes a solenoid operatively connected to a valve, and wherein the controller energizes the solenoid to close the valve when the impeding means is moved to its free-circulation position.

4. Apparatus for controlling lubrication of a clutchless compressor, wherein the compressor is driven by a mechanical drive source to compress and recirculate refrigerant in a refrigerant circuit, and wherein the refrigerant includes lubricant for the compressor, the apparatus comprising:

a refrigerant circulation impeding means for impeding refrigerant from circulating in the refrigerant circuit, the impeding means being controllably moved between a circulation-impeding position where refrigerant is impeded from circulation in the refrigerant circuit and a free-circulation position where refrigerant may freely circulate in the refrigerant circuit;

a refrigerant circulation controller for setting the impeding means in its free-circulation position for a predetermined period of time starting from a time of activation of the drive source such that lubrication is positively supplied to the compressor by the refrigerant when the compressor is initially driven after a time of inactivity, and for setting the impeding means in its circulation impeding position when the predetermined period elapses, wherein the controller periodically moves the impeding means to its free-circulation position during continued activation of the drive source to periodically lubricate the compressor.

5. Apparatus for controlling lubrication of a clutchless compressor, wherein the compressor is driven by a mechanical drive source to compress and recirculate refrigerant in a refrigerant circuit, and wherein the refrigerant includes lubricant for the compressor, the apparatus comprising:

a refrigerant circulation impeding means for impeding refrigerant from circulating in the refrigerant circuit, the impeding means being controllably moved between a circulation-impeding position where refrigerant is impeded from circulation in the refrigerant circuit and a free-circulation position where refrigerant may freely circulate in the refrigerant circuit;

a refrigerant circulation controller for setting the impeding means in its free-circulation position for a predetermined period of time starting from a time of activation of the drive source such that lubrication is positively supplied to the compressor by the refrigerant when the compressor is initially driven after a time of inactivity, and for setting the impeding means in its circulation impeding position when the predetermined period elapses;

wherein the drive source has an electric source for providing power when the drive source is activated, the impeding means includes an electric drive circuit that generates heat when activated, the controller includes a heat sensing device electrically connected to the drive circuit, the electric drive circuit and the heat sensing device are connected to the electric source, and the heat sensing device is located proximate to the drive circuit such that the predetermined time corresponds to a time during which the heat sensing device is heated to at least a predetermined temperature due to its proximity to the drive circuit.

6. The apparatus according to claim 5, wherein the heat sensing device is a thermistor.

7. The apparatus according to claim 5, wherein the heat sensing device is a heat detecting switch.

8. The apparatus according to claim 5, wherein the electric drive circuit includes a resistor, and the heat sensing device is placed in close proximity to the resistor.

9. Apparatus for controlling lubrication of a clutchless compressor, wherein the compressor is driven by a mechanical drive source to compress and recirculate refrigerant in a refrigerant circuit, and wherein the refrigerant includes lubricant for the compressor, the apparatus comprising:

a refrigerant circulation impeding means for impeding refrigerant from circulating in the refrigerant circuit, the impeding means being controllably moved between a circulation-impeding position where refrigerant is impeded from circulation in the refrigerant circuit and a free-circulation position where refrigerant may freely circulate in the refrigerant circuit;

a refrigerant circulation controller for controlling the impeding means such that the impeding means is moved to its free-circulation position for discrete predetermined periods of time during the activation of the drive source such that lubrication is positively supplied to the compressor by the refrigerant during the predetermined periods, and the predetermined periods of time are separated by intervals of time during the activation of the drive source, and wherein the impeding means is set in its circulation impeding position when each predetermined period elapses.

10. The apparatus according to claim 9, wherein the controller is connected to a sensor for counting the number of revolutions of a rotating member operatively connected to the drive source, and the controller determines the predetermined period of time based on the completion of a predetermined number of revolutions of the rotating member.

11. The apparatus according to claim 9, wherein the impeding means includes a solenoid operatively connected to a valve, and wherein the controller energizes the solenoid to close the valve when the impeding means is moved to its free-circulation position.

12. The apparatus according to claim 9, wherein the drive source has an electric source for providing power when the drive source is activated, and wherein the impeding means includes an electric drive circuit that generates heat when activated, and wherein the controller includes a heat sensing device electrically connected to the drive circuit, and wherein the electric drive circuit and the heat sensing device are connected to the electric source, and wherein the heat sensing device is located proximate to the drive circuit such that the predetermined time corresponds to time during which the heat sensing device is heated to at least a predetermined temperature due to its proximity to the drive circuit.

13. The apparatus according to claim 12, wherein the drive circuit and the heat sensing device are constructed to set the impeding means to allow free circulation of refrigerant in the refrigerant circuit when the drive source is initially activated after a period of inactivity, and wherein the drive circuit subsequently heats the heat sensing device to cause the controller to set the impeding means to its circulation impeding position.

14. A method of controlling lubrication of a clutchless compressor, wherein the compressor is driven by a mechanical drive source to compress and recirculate refrigerant in a refrigerant circuit, and wherein the refrigerant includes lubricant for the compressor, the method comprising the steps of:

impeding refrigerant from circulating in the refrigerant circuit with an impeding means, the impeding means being controllably moved between a circulation-impeding position where refrigerant is impeded from circulation in the refrigerant circuit and a free-circulation position where refrigerant may freely circulate in the refrigerant circuit;

controlling the impeding means such that the impeding means is set in its free-circulation position for a predetermined period of time starting from a time of activation of the drive source such that lubrication is positively supplied to the compressor by the refrigerant when the compressor is initially driven after a time of inactivity; and setting the impeding means to its circulation impeding position when the predetermined period elapses.

15. The method according to claim 14, including the step of periodically moving the impeding means to its free-circulation position for discrete periods of time during continued activation of the drive source to lubricate the compressor.

16. The method according to claim 14, including the step of counting the number of revolutions of a rotating member operatively connected to the drive source, and determining the predetermined period of time based on the completion of a predetermined number of revolutions of the rotating member as counted from the activation of the drive source.

17. The method according to claim 14, including the step of energizing a solenoid operatively connected to a valve to close the valve when the impeding means is moved to its free-circulation position.

18. The method according to claim 14, including the step of determining the predetermined time according to a time during which a heat sensing device is heated to at least a predetermined temperature due to its proximity to a drive circuit of the impeding means.

19. A method for controlling lubrication of a clutchless compressor, wherein the compressor is driven by a mechanical drive source to compress and recirculate refrigerant in a refrigerant circuit, and wherein the refrigerant includes lubricant for the compressor, the method comprising the steps of:

impeding refrigerant from circulating in the refrigerant circuit with an impeding means, and controllably moving the impeding means between a circulation-impeding position where refrigerant is impeded from circulation in the refrigerant circuit and a free-circulation position where refrigerant may freely circulate in the refrigerant circuit;

controlling the impeding means such that the impeding means is moved to its free-circulation position for discrete predetermined periods of time during the activation of the drive source such that lubricant is positively supplied to the compressor by the refrigerant during the predetermined periods, and the predetermined periods of time are separated by intervals of time during the activation of the drive source; and setting the impeding means to its circulation impeding position when each predetermined period elapses.

20. The method according to claim 19, including the step of counting the number of revolutions of a rotating member operatively connected to the drive source, and determining the predetermined period of time based on the completion of a predetermined number of revolutions of the rotating member.

21. The method according to claim 19, including the step of energizing a solenoid operatively connected to a valve to close the valve when the impeding means is moved to its free-circulation position.

22. The method according to claim 19, including the step of determining the predetermined time according to a time during which a heat sensing device is heated to at least a predetermined temperature due to its proximity to a drive circuit of the impeding means.

* * * * *

UNITED STATES PATENT AND TRADEMARK OFFICE

CERTIFICATE OF CORRECTION

PATENT NO. : 5,807,076

DATED : September 15, 1998

INVENTOR(S) : Masahiro Kawaguchi, et al.

It is certified that error appears in the above-indentified patent and that said Letters Patent is hereby corrected as shown below:

Column 5, line 27, after " block 1", remove --.--.

Column 6, line 56,after "$IC_1$-, remove -- , --.

Column 7, line 67, change " performer" to –performed--.

Column 8, line 54, remove " from".

Column 11, line 20, change " condenser " to – capacitor--.

Signed and Sealed this

Twenty-sixth Day of October, 1999

*Attest:*

Q. TODD DICKINSON

*Attesting Officer*

*Acting Commissioner of Patents and Trademarks*